US010436431B2

(12) United States Patent
Miller

(10) Patent No.: US 10,436,431 B2
(45) Date of Patent: Oct. 8, 2019

(54) ADJUSTABLE DEPTH ANCHORING SYSTEM FOR AN UNDERWATER LIGHT

(71) Applicant: Steven Miller, Pinellas Park, FL (US)

(72) Inventor: Steven Miller, Pinellas Park, FL (US)

( * ) Notice: Subject to any disclaimer, the term of this patent is extended or adjusted under 35 U.S.C. 154(b) by 0 days.

(21) Appl. No.: 14/682,437

(22) Filed: Apr. 9, 2015

(65) Prior Publication Data

US 2015/0219316 A1 Aug. 6, 2015

Related U.S. Application Data

(63) Continuation-in-part of application No. 14/070,606, filed on Nov. 4, 2013, now abandoned, which is a continuation of application No. 13/857,206, filed on Apr. 5, 2013, now Pat. No. 8,690,374, which is a continuation of application No. 13/655,107, filed on Oct. 18, 2012, now Pat. No. 8,444,283.

(51) Int. Cl.

| | |
|---|---|
| ***F21V 15/01*** | (2006.01) |
| ***F21V 17/10*** | (2006.01) |
| ***F21V 29/00*** | (2015.01) |
| ***F21V 31/00*** | (2006.01) |
| ***F21V 29/507*** | (2015.01) |
| *F21V 17/16* | (2006.01) |
| *F21Y 115/10* | (2016.01) |
| *F21Y 107/40* | (2016.01) |

(52) U.S. Cl.

CPC ..... *F21V 29/30* (2013.01); *F21V 29/507* (2015.01); *F21V 31/005* (2013.01); *F21V 17/164* (2013.01); *F21Y 2107/40* (2016.08); *F21Y 2115/10* (2016.08); *Y10T 29/49117* (2015.01); *Y10T 29/49947* (2015.01)

(58) Field of Classification Search

CPC .. F21V 29/30; F21V 29/507; F21V 29/49117; F21V 29/49947; F21V 17/164; F21V 31/005

USPC ..... 362/362, 158, 101, 294, 802, 184, 318, 362/373, 391, 477, 186; 43/17.5

See application file for complete search history.

(56) References Cited

U.S. PATENT DOCUMENTS 2,485,087 A * 10/1949 Diamond ..... A01K 93/02 362/158
3,510,978 A * 5/1970 Murdock ..... A01K 75/02 43/17.1

(Continued)

*Primary Examiner* — Karabi Guharay
*Assistant Examiner* — Arman B Fallahkhair
(74) *Attorney, Agent, or Firm* — Tiffany C. Miller; Inventions International Inc.

(57) ABSTRACT

An underwater dock light having an adjustable anchoring system having a capturing assembly with an upper capturing housing located opposite a lower capturing housing. The upper capturing housing can have at least one cord opening configured to receive a cord. The upper capturing housing can have a cord capturing structure. The cord is configured to contact a portion of the cord capturing structure. A fastener is configured to connect the upper capturing housing to the lower capturing housing. The cord is captured between the cord capturing structure of the upper capturing housing and a surface of the lower capturing housing. An anchoring weight is configured to connect to the capturing assembly. The anchoring weight has an opening. The upper capturing housing and lower capturing housing are configured to retain the anchoring weight.

6 Claims, 34 Drawing Sheets

(56) References Cited

U.S. PATENT DOCUMENTS

| | | | | | |
|---|---|---|---|---|---|
| 3,836,762 | A * | 9/1974 | Thomason | F21V 31/00 | 362/186 |
| 4,649,660 | A * | 3/1987 | Kurka | A01K 93/02 | 43/17.5 |
| 4,916,850 | A * | 4/1990 | Dodge | A01K 91/03 | 24/115 F |
| 6,481,148 | B1 * | 11/2002 | Lindgren | A01K 85/01 | 362/158 |
| 6,557,496 | B2 * | 5/2003 | Herrenbruck | A63H 5/00 | 119/707 |
| 7,607,253 | B2 * | 10/2009 | Makowski | A01K 91/06 | 43/17.5 |
| 2011/0121727 | A1 * | 5/2011 | Sharrah | F21L 4/00 | 315/32 |
| 2011/0305520 | A1 * | 12/2011 | West | B63C 11/30 | 405/186 |

* cited by examiner

ADJUSTABLE DEPTH ANCHORING SYSTEM FOR AN UNDERWATER LIGHT

CROSS REFERENCE TO RELATED APPLICATIONS

This application is a continuation-in-part application entitled, "Adjustable Depth Anchoring System For An Underwater Light", which claims priority to co-pending U.S. Non-Provisional patent application Ser. No. 14/070,606 filed Nov. 4, 2013, entitled, "Underwater Light Having A Flow Through Water Cooling System", which claims priority to U.S. Non-Provisional patent application Ser. No. 13/857,206, entitled, "Underwater Light Having A Faceted Water-Cooled Thermally Conductive Housing" which claims priority to U.S. Non-Provisional patent application Ser. No. 13/655,107 filed Oct. 18, 2012, entitled, "SYSTEMS AND METHODS FOR UNDERWATER LIGHTING."

BACKGROUND OF THE INVENTION

1. Field of the Invention

This invention relates, generally, to underwater dock lights.

2. Background Art

The light emitting unit in many conventional underwater lights are incandescent bulbs that are not energy efficient. Metal hydride lighting systems require the use of bulky transformers that are also not energy efficient compared to compact fluorescent lighting (CFL) or high intensity light emitting diode (LED) systems. Transformers make the assembly more costly and are unsightly. Incandescent, metal hydride and CFL bulbs use hazardous high voltage A/C current. When these bulbs are used in underwater lights, the use of a ground fault circuit interrupt (GFCI) is recommended for safe operation. GFCI's add additional cost to an underwater light system. LED systems can operate with non-hazardous, low voltage D/C current which is a much safer alternative to the prior art A/C systems. Moreover, incandescent bulbs, CFL bulbs, and metal hydride bulbs have a short life expectancy in comparison to LEDs.

High intensity LEDs used in light systems produce concentrated heat at each LED. Although an underwater light assembly has a relatively stable external temperature due to submersion, without a way of dissipating the heat from a concentrated point of each LED, the high intensity LED will overheat and become damaged.

There are several challenges to overcome with using high intensity LEDs in an underwater light system. One challenge being the need for the LED to be in contact with a heat sink capable of sufficiently transferring heat. The problem with a heat sink in an underwater light is determining how to cool the heat sink. Thus, there is a need for an improved method of cooling LEDs inside an underwater light.

Currently, most prior art underwater lights on the market operate in about ten feet or less of water. These underwater lights have a light emission that is configured to beam away from the light fixture housing, resulting in the light source emitting a beam of light. In shallow water, the light beaming upward results in an underwater light having a small diameter of light being illuminated. Thus, there is a need for an improved, underwater light that directs the light not only upward, but radiating outward to produce a large diameter of light being illuminated in shallow water.

Prior art underwater lights are not energy efficient compared to the diameter of light they produce. Thus, there is a need for an underwater light that produces a brighter light and a larger diameter of light in a body of water. This is more desirable to an observer and attracts more marine life to the site. More particularly, a brighter light is more effective at penetrating murky water.

Prior art underwater lights illuminate the surrounding water a single color. Thus, there is a need for an improved underwater light that illuminates the surrounding water with multiple colors simultaneously.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for an underwater light that is configured to be internally water cooled by a thermally conductive housing having LED circuit boards mounted at an angle to produce a large diameter of light which also includes improvements that overcome the limitations of prior art underwater lights, is now met by a new, useful, and non-obvious invention.

The novel underwater light includes a transparent cover positioned over a light fixture housing. The transparent cover is configured to fit over a light emitting unit including, but not limited to, an LED. Any light emitting unit is within the scope of this invention.

Though multi-color underwater lights aid in attracting and viewing marine life, they are also aesthetically pleasing to spectators. The transparent cover may have a lens that is removable from the transparent cover. This removable feature is accomplished with the transparent lens having a transparent lens latching structure that is inserted into a transparent cover opening.

The improved water cooling system dissipates the concentrated heat associated with LEDs to a point external of an underwater light, resulting in a substantially brighter light without damaging the LEDs. By having a stable way of cooling LEDs with water, the LEDs can be safely overdriven, producing a brighter light than they were originally designed to produce.

BRIEF DESCRIPTION OF THE DRAWINGS

For a fuller understanding of the nature and objects of the invention, reference should be made to the following detailed description, taken in connection with the accompanying drawings, in which:

FIG. 13 is a side perspective view depicting an embodiment of the thermally conductive housing having an opening at its peak for water to flow through;

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 19:
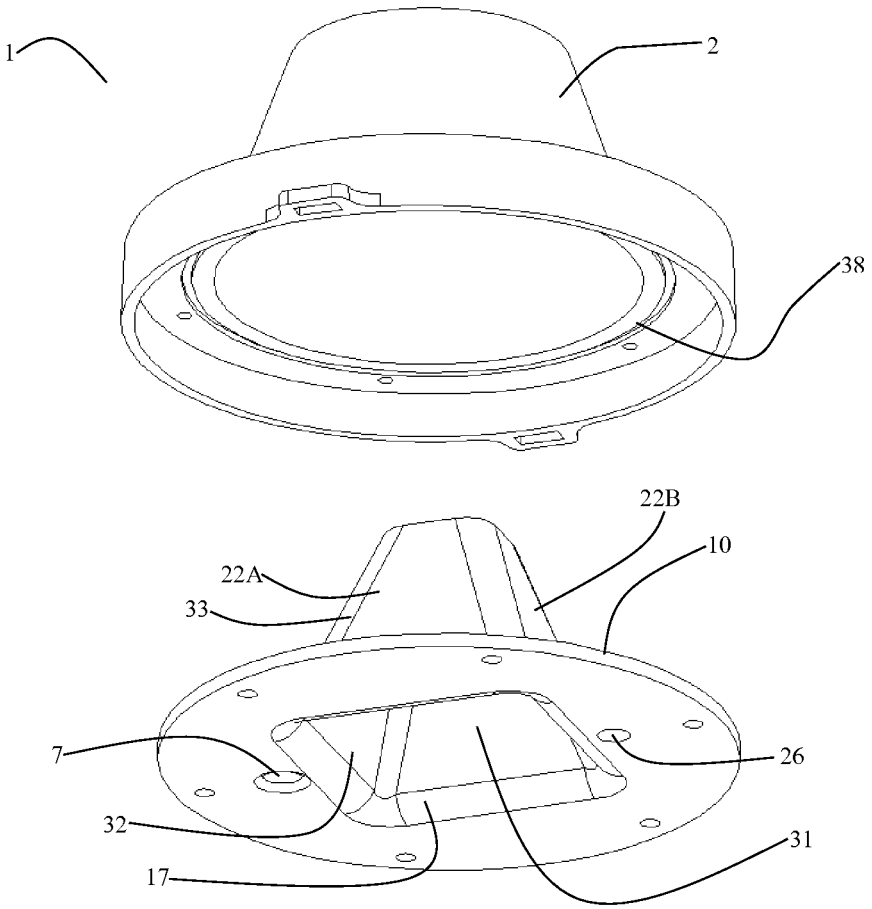
FIG. 19 is a rear exploded view depicting an embodiment of the transparent cover and thermally conductive housing.

FIG. 19 illustrates one embodiment of housing 10 having valve stem opening 26 capable of removing or filling underwater light 1 with a gas including, but not limited to; an inert gas. An alternate embodiment not shown includes light fixture housing 4A having a valve stem opening located thereon. It is also within the scope of this invention to evacuate underwater light 1 of all gas and to be left in a state of vacuum. The removal of air containing moisture eliminates the oxidation of internal electrical components. Additionally, pressurizing underwater light 1 allows the assembly to be post tested for potential leaks at the point of manufacture. Pressure inside the assembly also adds a counter force to the crushing effects of water at a depth. It is also within the scope of this invention to connect an opening of the light to a regulated and pressurized gas supply that would fill or release a gas inside of underwater light 1 to maintain a constant force against the crushing effects of surrounding water, even at extreme depths. Uses for the invention could branch out to marine exploration or construction.

Underwater light 1 has antifouling circuitry (not shown) configured to automatically cycle a power interrupt circuit (not shown) to underwater light 1 "on" and "off" multiple times during periods of non-use. The frequency and duration of cycles will vary in differing conditions including, but not limited to, freshwater or saltwater. The antifouling circuitry includes, but is not limited to, a software program. It is also within the scope of the invention to include antifouling chemicals in the injection molding process of components including, but not limited to, transparent lens 3 or transparent cover 2. Bright light and heat generated by underwater light 1 deters growth from attaching to transparent lens 3, transparent cover 2, and cooling surfaces of housing 10.

Underwater light 1 has smart circuitry (not shown) that can accept commands and communicate with a user through a series of light blinks or pauses between light blinks. The smart circuitry controls a power interrupt circuit (not shown) that powers a light emitting unit. A user can program the light to operate for a desired time span of each night by acknowledging a series of blinks from underwater light 1. Each series of blinks indicate an "on" period of time or an "off" period of time per day. The user acknowledges a series of blinks from underwater light 1 by powering "off" the light after the desired series of blinks. The smart circuitry accepts the command associated with the desired series of blinks prior to powering down. It is also within the scope of this invention for the user to cycle the power to the light, causing the smart circuitry to accept commands. For instance, a user could cycle the power "on" and "off" three times within thirty seconds, which would cause the smart circuitry to operate "on" twelve hours and "off" twelve hours each day. The smart circuitry can also monitor and communicate faults including, but not limited to, a high temperature condition and also shut down the light if it overheats. The smart circuitry can indicate overheating to a user through a series of flashes until a user rectifies the cause of overheating. Though the above methods of communicating are preferred embodiments, all methods of communicating through the power supplied to underwater light 1 and controlling other features are within the scope of the invention.

Figure 3:
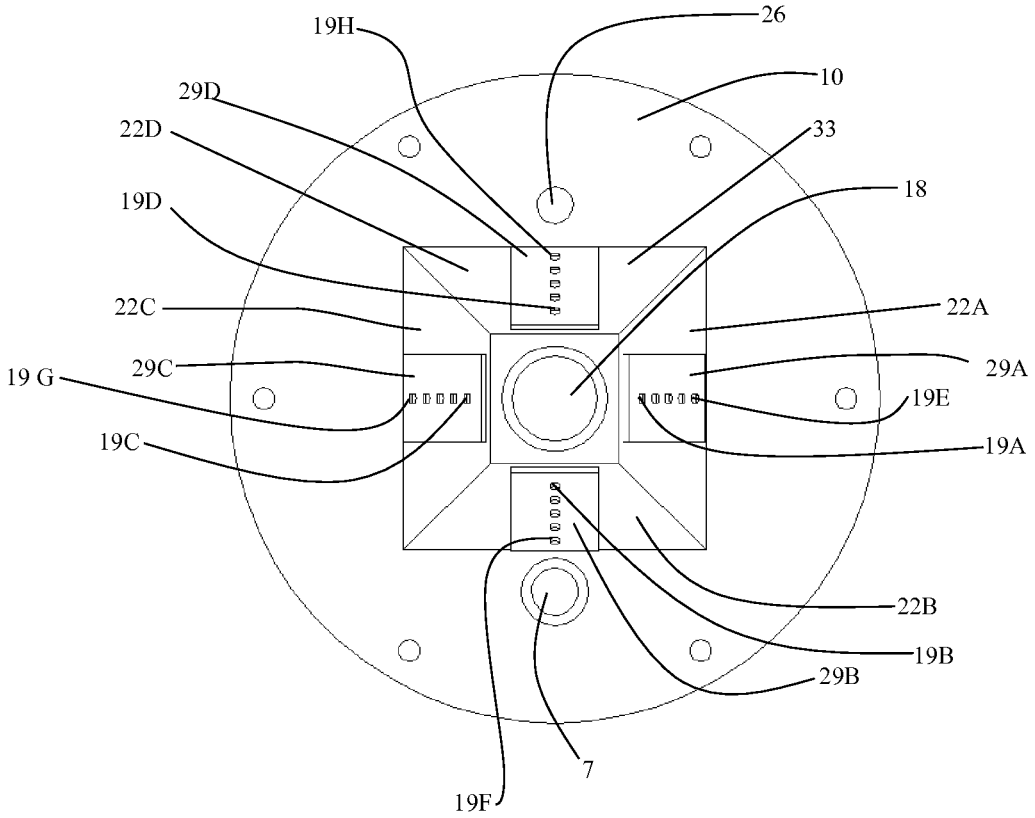
FIG. 3 is a top view of the thermally conductive housing.
Figure 18:
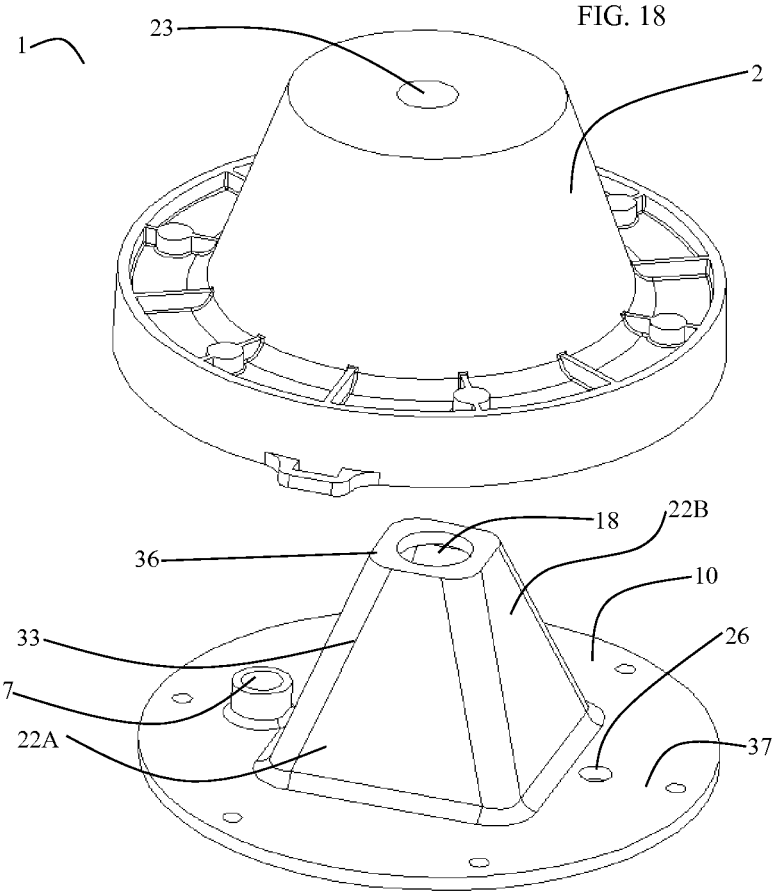
FIG. 18 is a top exploded view depicting an embodiment of the transparent cover and thermally conductive housing.

FIG. 18 shows transparent cover 2 is positioned over housing 10. As shown in FIG. 19, housing 10 has chamber 31 formed from an interconnection of primary supporting surface 22A, secondary supporting surface 22B, tertiary supporting surface 22C (FIG. 3), and quaternary supporting surface 22D (FIG. 3). FIG. 3 shows each of supporting surfaces 22A, 22B, 22C, and 22D are formed on chamber wall secondary side 33.

Figure 2:
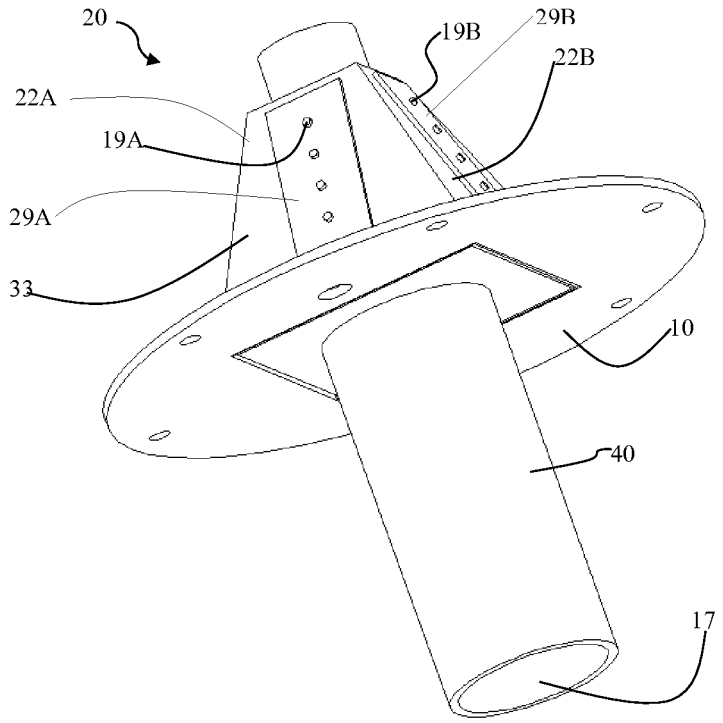
FIG. 2 is a rear perspective view of the internal cooling system.
Figure 15:
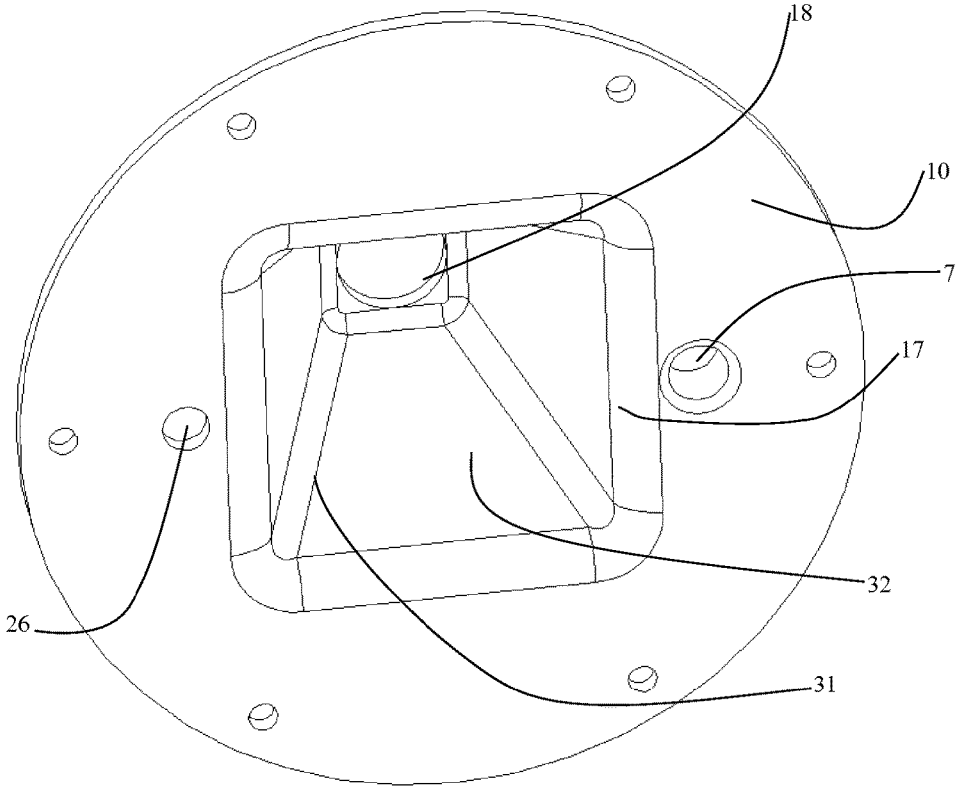
FIG. 15 is a perspective view depicting an embodiment of housing 10 having an opening at its base for water to enter chamber 31.
Figure 16:
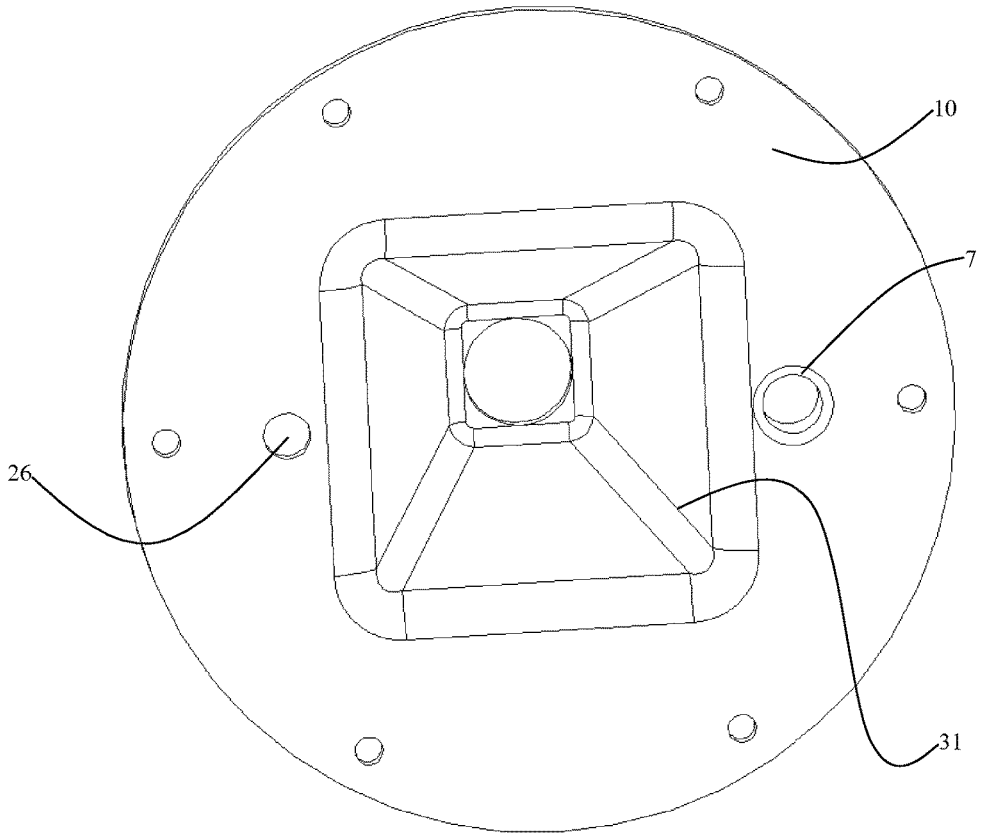
FIG. 16 is a rear perspective view depicting the thermally conductive housing.
Figure 20:
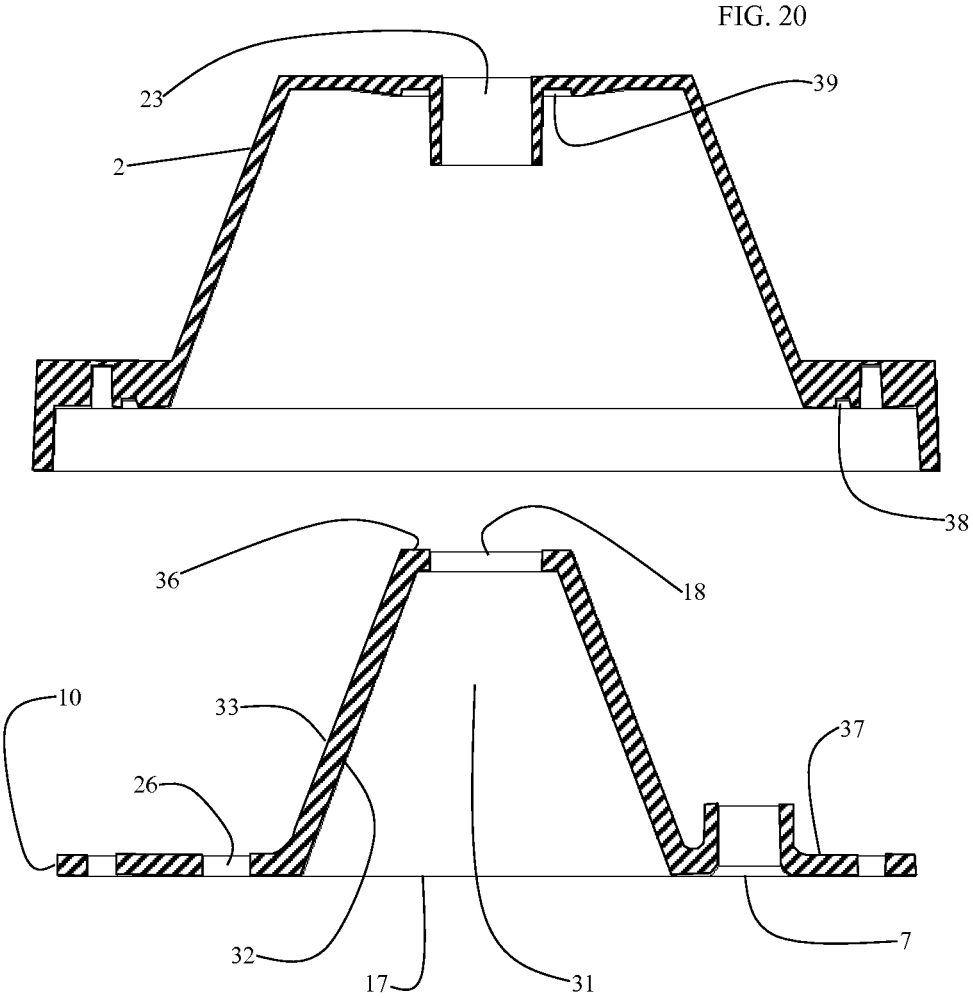
FIG. 20 is a side cut away exploded view depicting the transparent cover and thermally conductive housing.

FIG. 2 shows internal cooling system 20 having housing 10 having primary chamber aperture 17 that is in direct contact with a surrounding water source. Primary chamber aperture 17 receives water and absorbs heat generated by light emitting units 19A and 19 B through chamber wall primary side 32 and chamber wall secondary side 33 as shown in FIG. 20. FIG. 15 depicts secondary chamber aperture 18 that expels heated water from chamber 31. Chamber 31 has a larger perimeter tapering to a smaller perimeter. Chamber 31 has primary chamber aperture 17 located on an end of chamber 31 that receives surrounding water of an ambient temperature. Primary chamber aperture 17 is configured to allow surrounding water to substantially fill chamber 31 and absorb heat from chamber 31 generated from light emitting units 19A, 19B, 19C, and 19D as shown in FIG. 3, thereby, sufficiently cooling light emitting units 19A, 19B, 19C, and 19D. FIG. 3 depicts each of supporting surfaces 22A, 22B, 22C, and 22D are in thermal communication with light emitting units 19A, 19B, 19C, and 19D generating heat. Each of supporting surfaces 22A, 22B, 22C, and 22D supports at least one light emitting unit.

Figure 4:
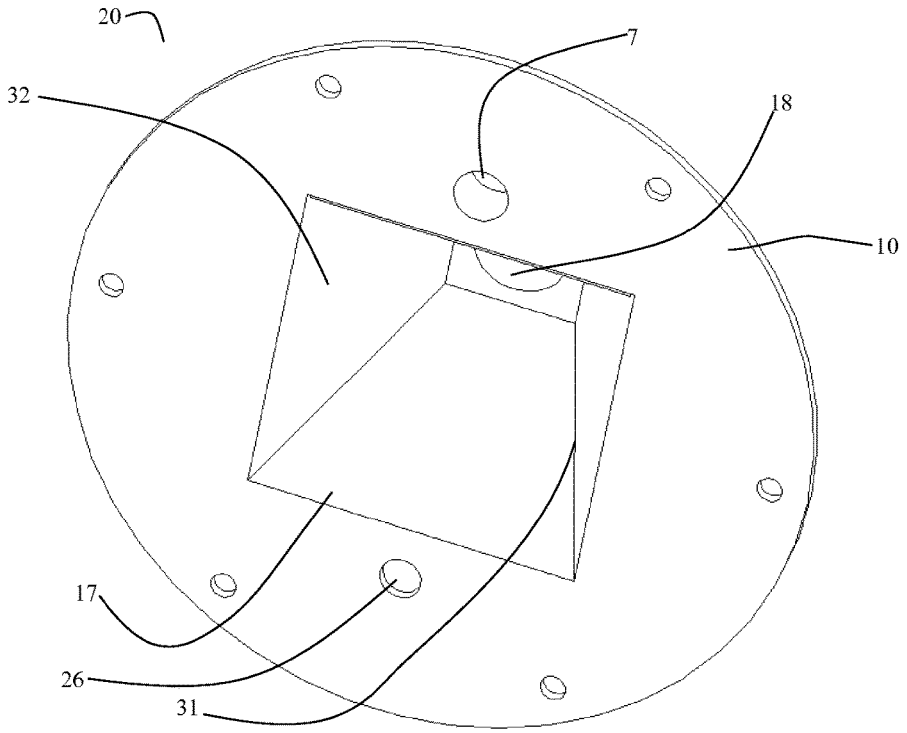
FIG. 4 is a rear perspective inside view of the thermally conductive housing chamber.
Figure 6:
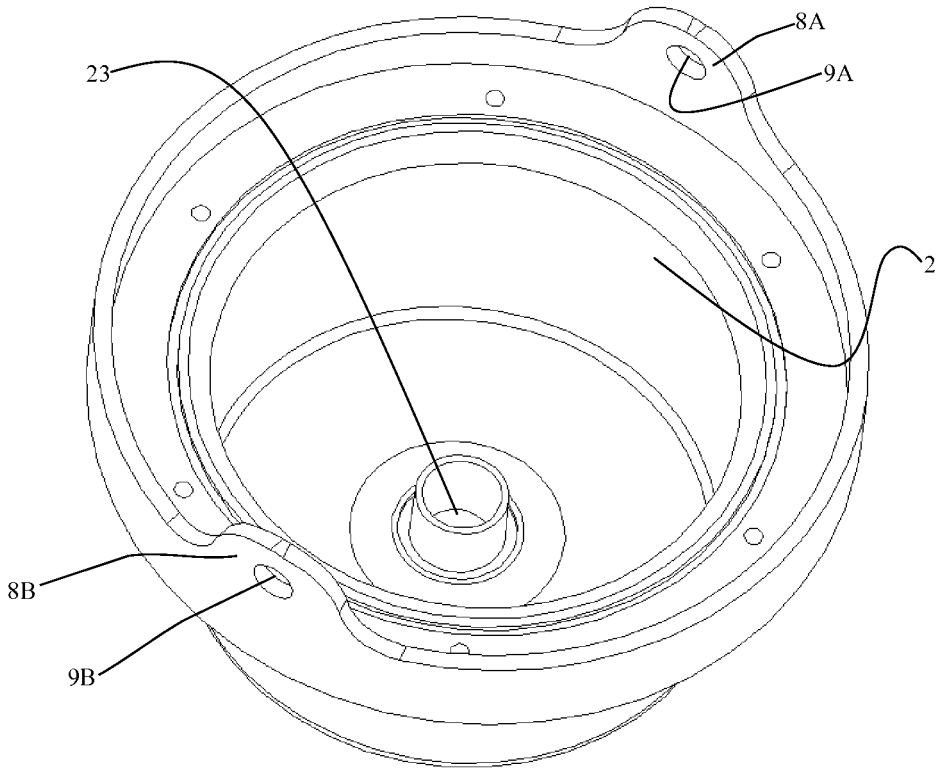
FIG. 6 is a rear perspective view of the transparent cover opening.

FIG. 4 shows housing 10 having secondary chamber aperture 18 located on an end of chamber 31 opposing primary chamber aperture 17. As shown in FIG. 20, chamber 31 of housing 10 is configured to allow surrounding water to flow through secondary chamber aperture 18 and transparent cover opening 23. FIG. 20 shows transparent cover 2 has a seal (not shown) between secondary O-ring channel 39 and primary O-ring mating surface 36 of housing 10. Transparent cover opening 23 is in hydro communication with primary chamber aperture 17 and secondary chamber aperture 18 of chamber 31. FIG. 6 shows transparent cover opening 23 configured to allow surrounding water to penetrate transparent cover 2 and transparent lens opening 25 (FIG. 9), allowing surrounding water to flow through secondary chamber aperture 18 and primary chamber aperture 17 as shown in FIG. 20. FIG. 20 also depicts housing 10 having chamber 31 with at least one wall having a chamber wall primary side 32 in contact with surrounding water. Chamber 31 has a supporting surface formed on a chamber wall secondary side 33 of at least one wall. The chamber wall secondary side 33 of at least one wall is located opposite the chamber wall primary side 32 of at least one wall. At least one light emitting unit is supported by the supporting surface. Chamber wall primary side 32 of at least one wall is in thermal communication with at least one light emitting unit and heat is transferred from at least one light emitting unit to the surrounding water.

Figure 8:
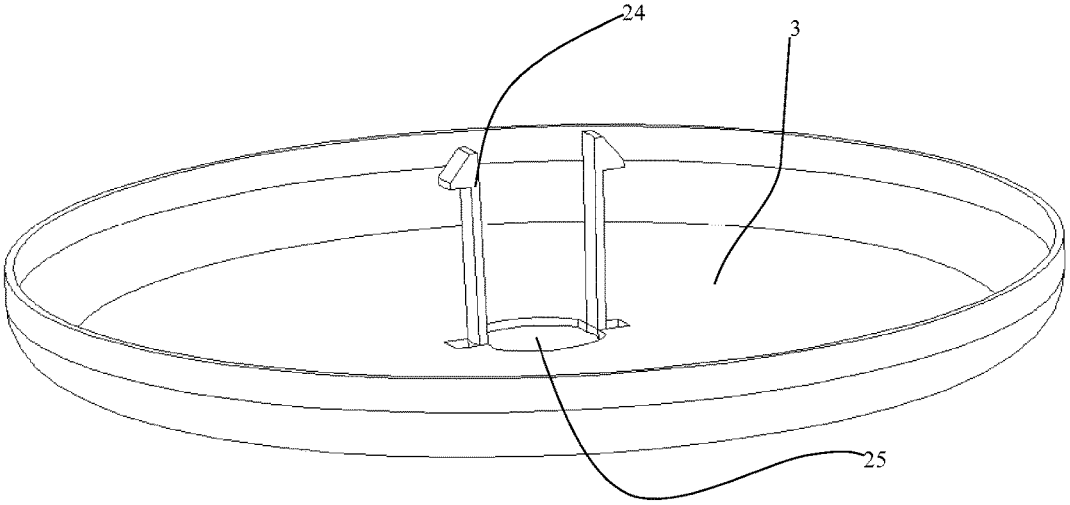
FIG. 8 is a side perspective view of the latching structure of the transparent lens.

FIG. 8 depicts transparent lens 3 having transparent lens opening 25 and transparent lens latching structure 24 configured to connect transparent lens 3 to the end of transparent cover 2 (FIG. 18). Transparent cover opening 23 (FIG. 18) of transparent cover 2 receives transparent lens latching structure 24 of transparent lens 3. Transparent lens latching structure 24 is located on the surface of transparent lens 3 facing transparent cover 2 and is received by transparent cover opening 23 positioned over a light emitting unit. Transparent cover opening 23 receives and captures transparent lens latching structure 24. Transparent lens latching structure 24 includes, but is not limited to; having at least one barbed latching structure. It is also within the scope of the invention for transparent cover 2 to have latching structure 24 captured by transparent lens 3.

FIG. 6 shows transparent cover 2 having two attaching structures 8A and 8B located on the end of transparent cover 2. The two attaching structures 8A and 8B each have one attaching structure opening 9A and 9B to receive attaching straps. The attaching strap includes, but is not limited to; a rope, a tie strap, a tether, or a chain. An alternate embodiment not shown includes two attaching structures 8A and 8B are located outboard of the perimeter of a primary chamber aperture 17 receiving surrounding water. The attaching straps are connected to an anchor configured to suspend underwater light 1 in a vertical orientation when submerged in a body of water.

Figure 30:
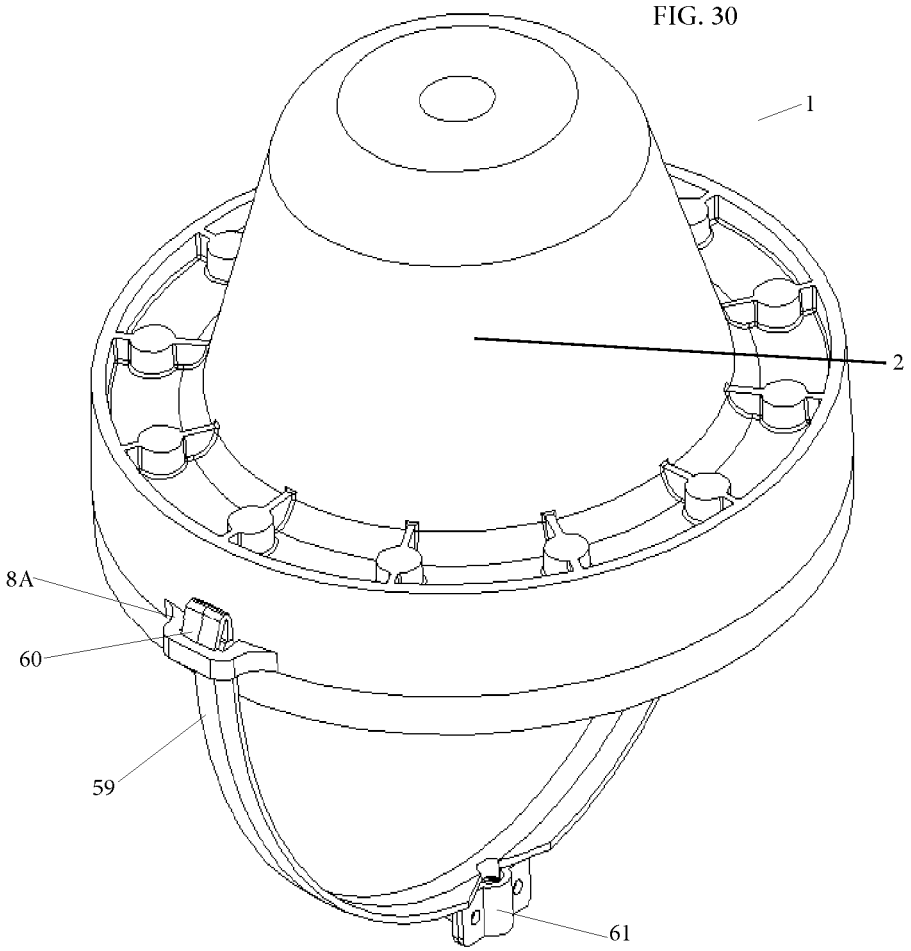
FIG. 30 is a perspective view of the underwater light connected to the attaching element.
Figure 31:
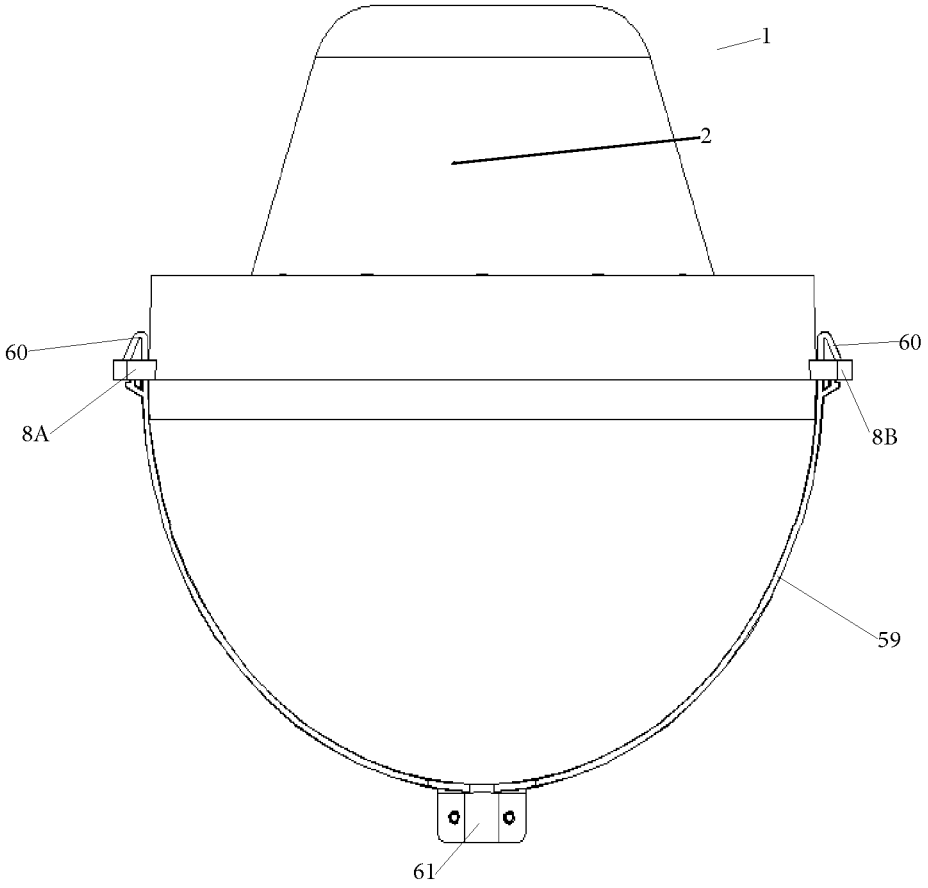
FIG. 31 is a side perspective view of the underwater light connected to the attaching element.
Figure 32:
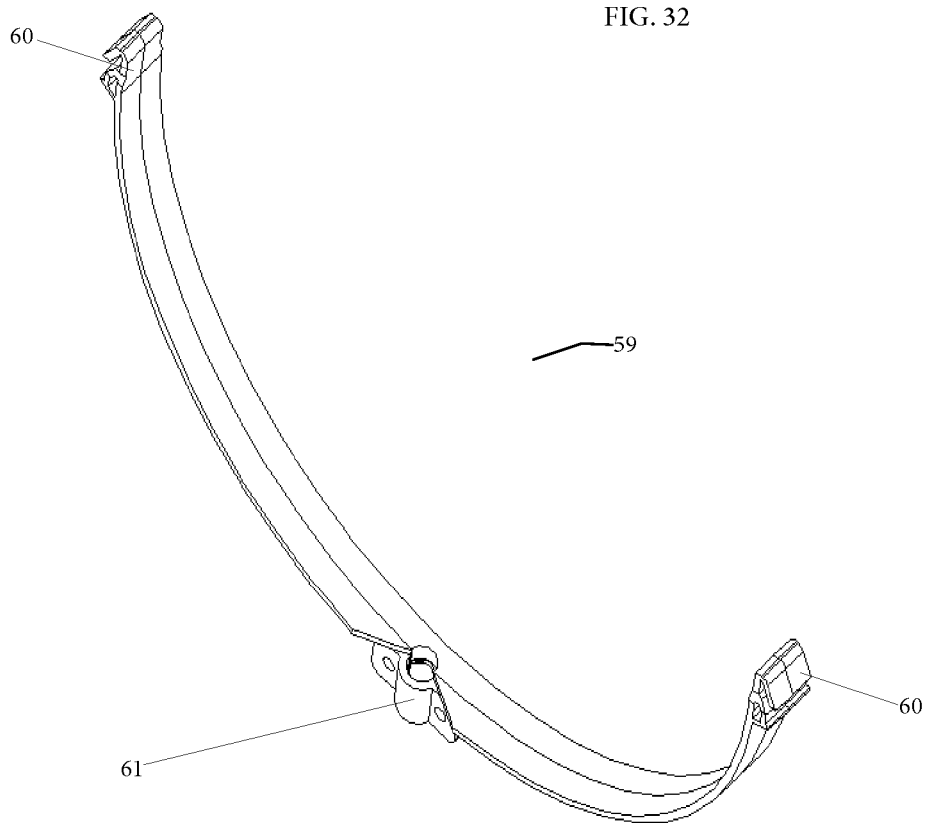
FIG. 32 is a perspective view of the attaching element.
Figure 33:
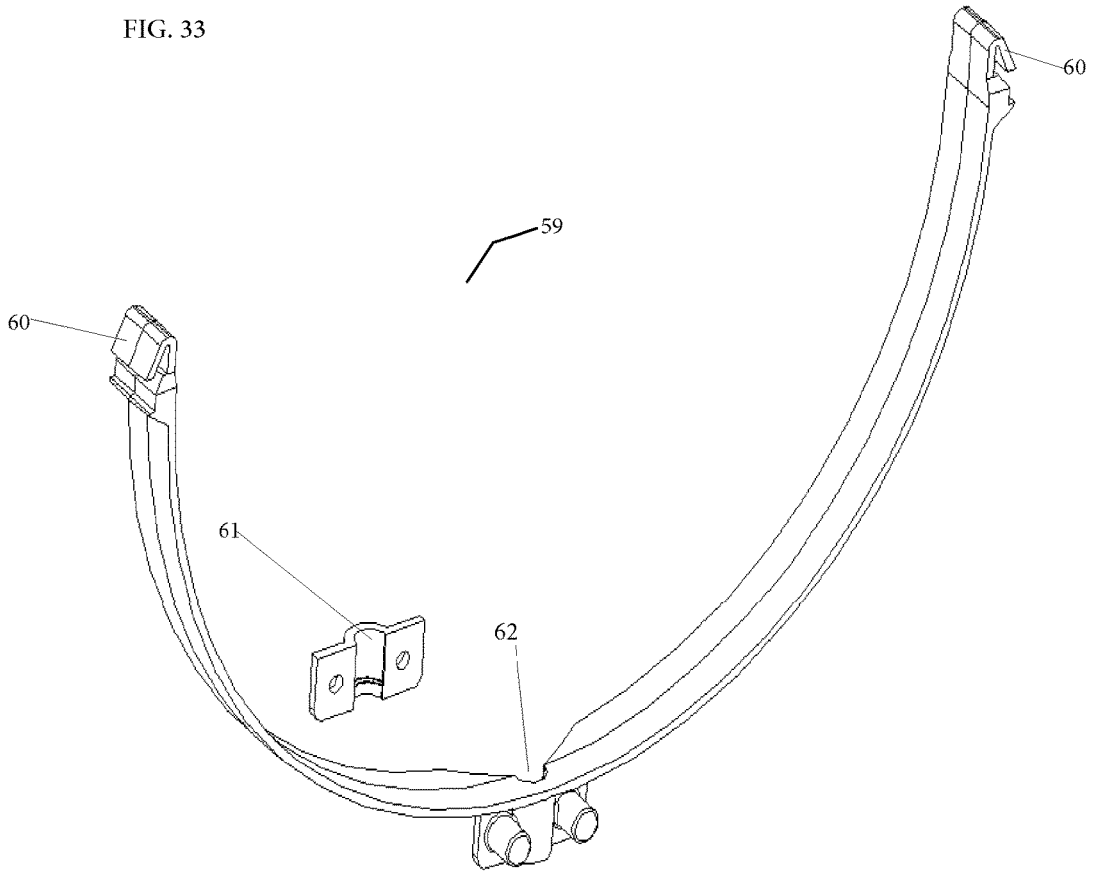
FIG. 33 is a perspective view of the attaching element and cord clamp.
Figure 34:
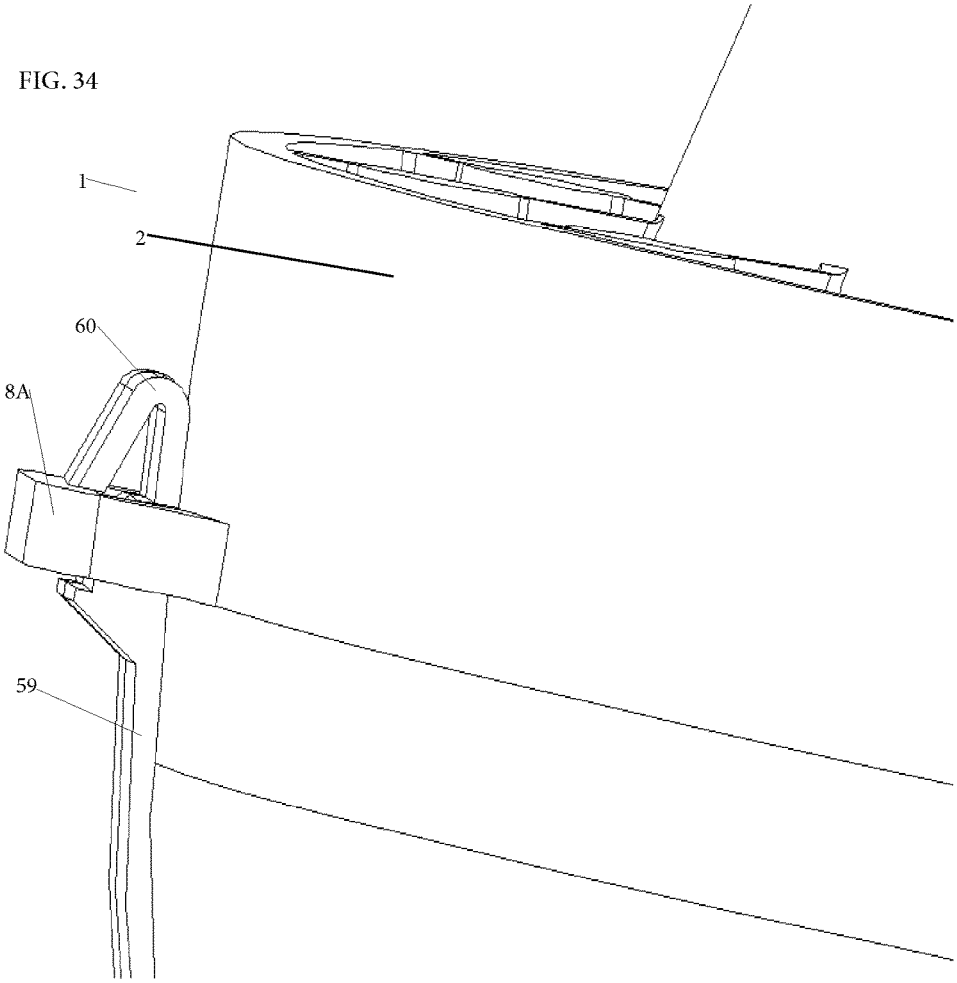
FIG. 34 is a perspective view of the attaching element having a latching structure being received by the attaching structure.

FIGS. 30, 31, and 34 depict underwater light 1 having transparent cover 2. Two attaching structures 8A (FIGS. 30, 31, and 34) and 8B (FIG. 31) are located on an end of transparent cover 2. The two attaching structures 8A and 8B receive latching structure 60 (FIGS. 30-34). FIGS. 30-34 show latching structure 60 located on an end of attaching strap 59 and another latching structure 60 is located on the other end of attaching strap 59. Cord clamp 61 (FIGS. 30, 31, 32, and 33) is connected to cord clamp receiving structure 62 (FIG. 33) of attaching strap 59.

Figure 21:
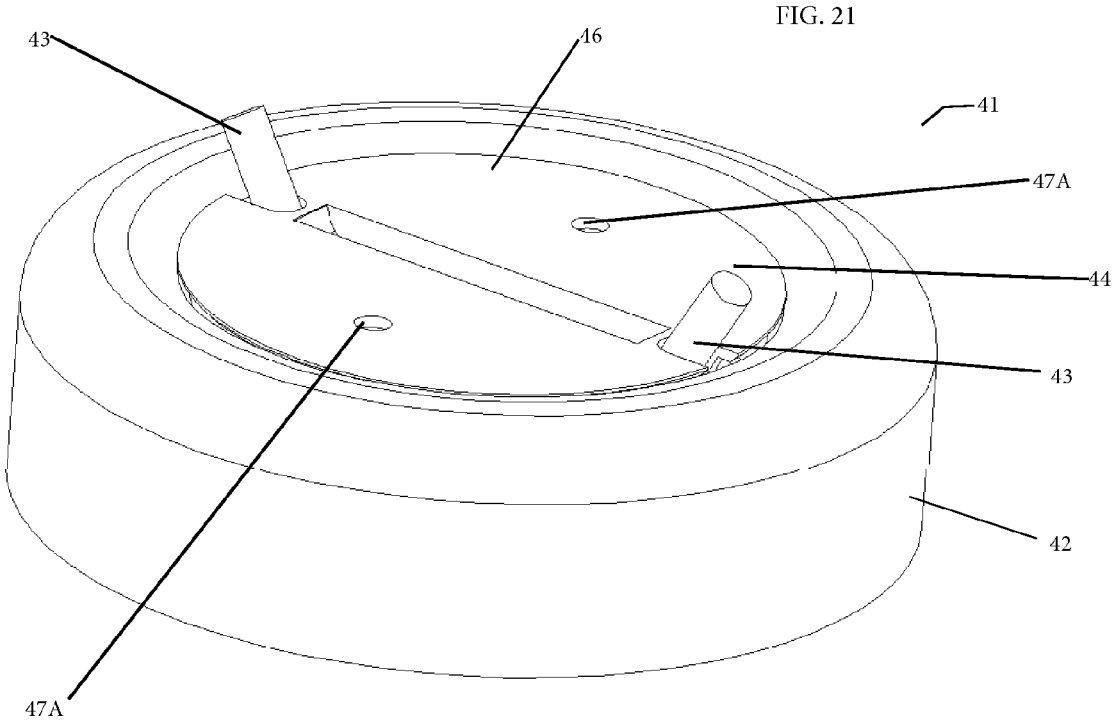
FIG. 21 is a perspective view of the adjustable depth anchoring system for an underwater light.
Figure 22:
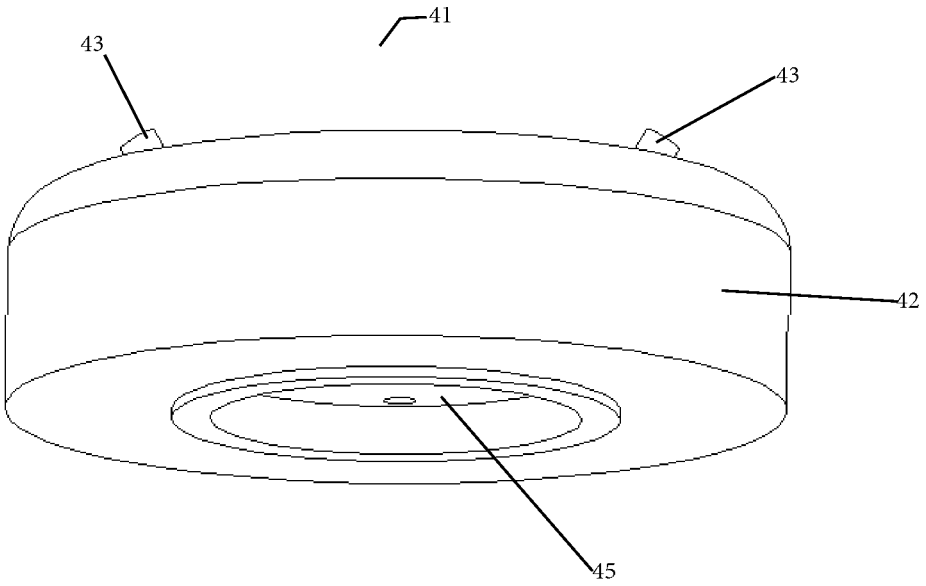
FIG. 22 is a rear perspective view of the adjustable depth anchoring system for an underwater light.
Figure 23:
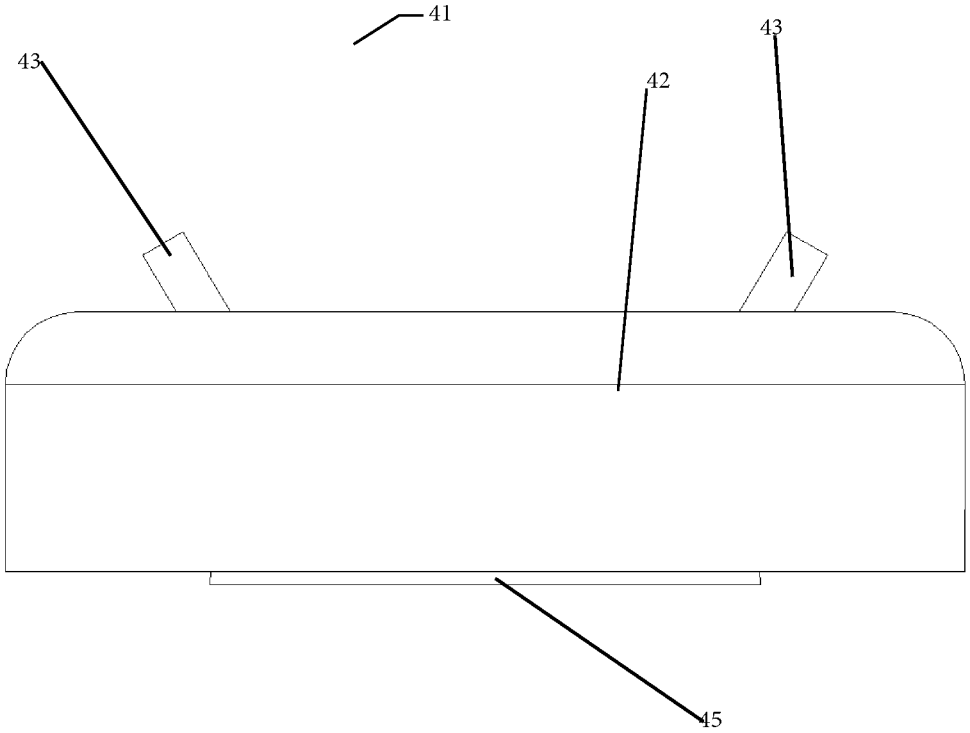
FIG. 23 is a side perspective view of the adjustable depth anchoring system for an underwater light.
Figure 24:
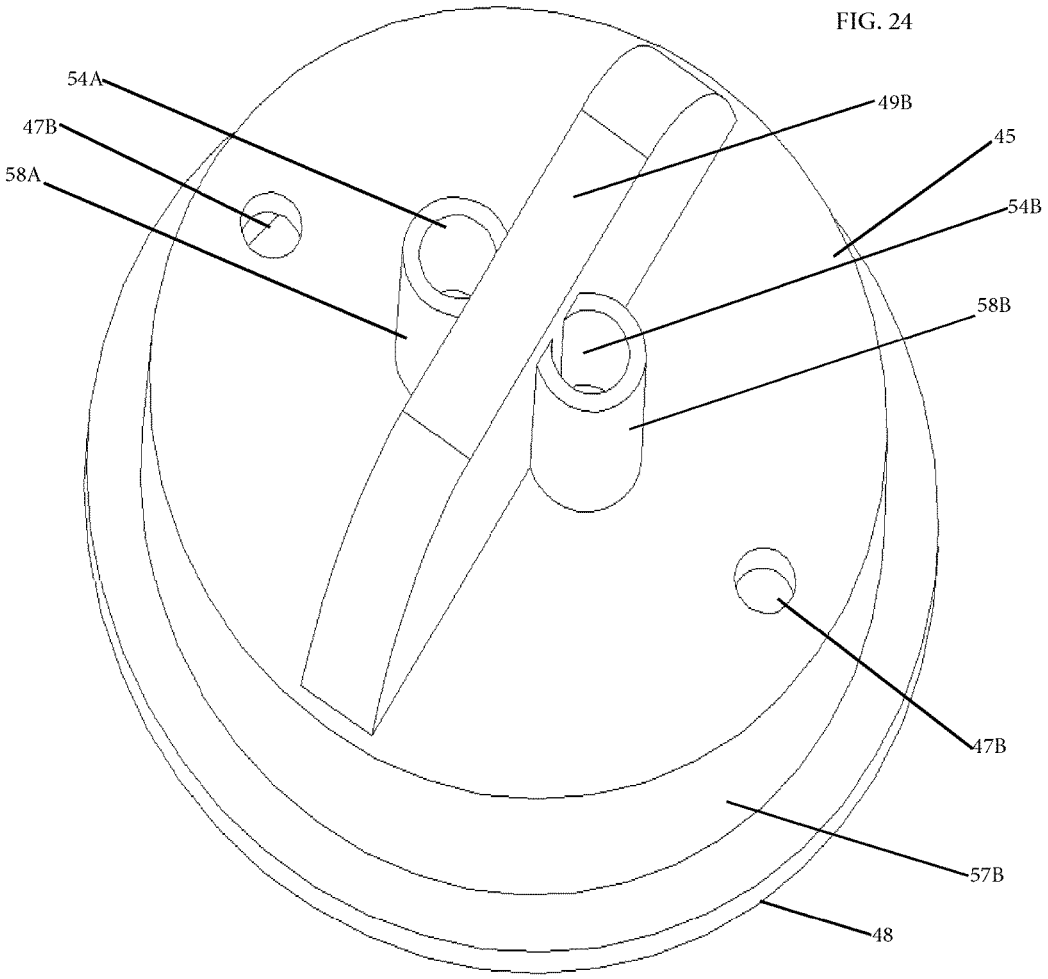
FIG. 24 is a top perspective view of the lower capturing housing.
Figure 26:
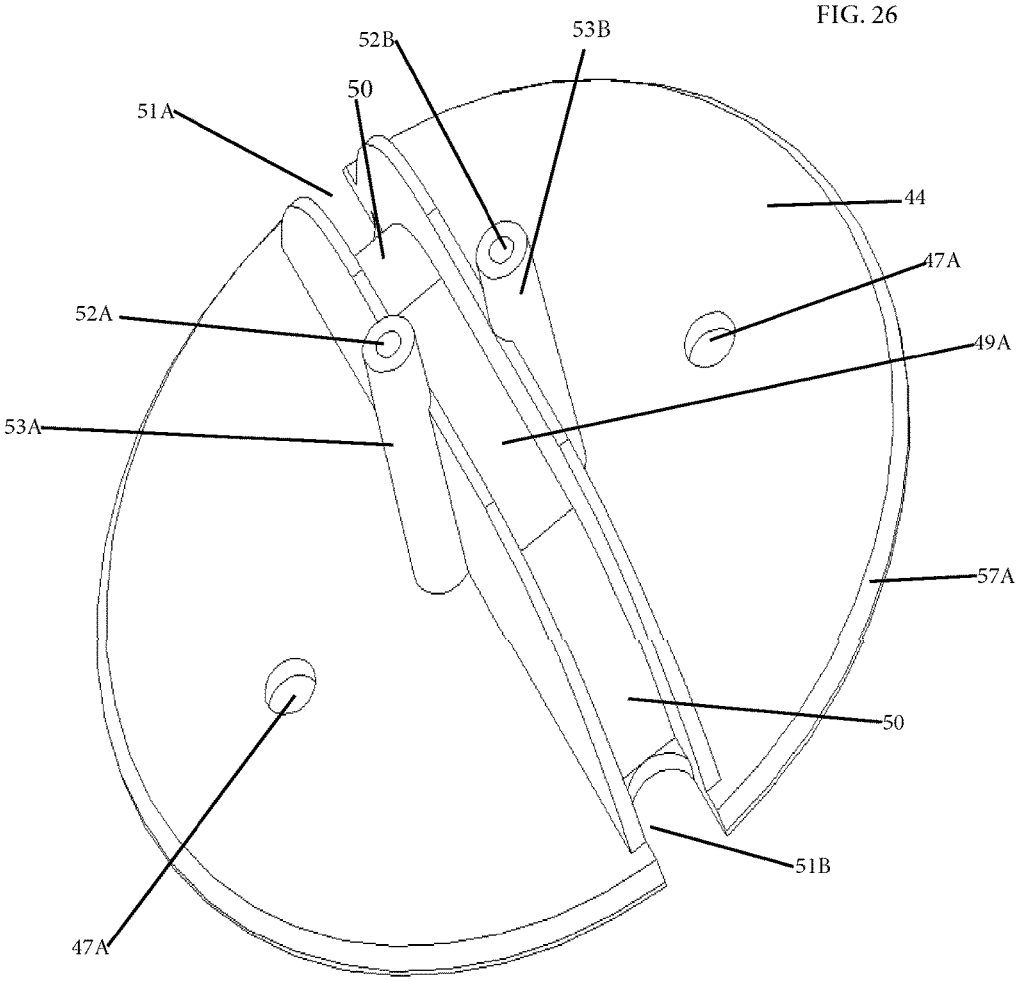
FIG. 26 is a perspective view of the upper capturing housing.
Figure 27:
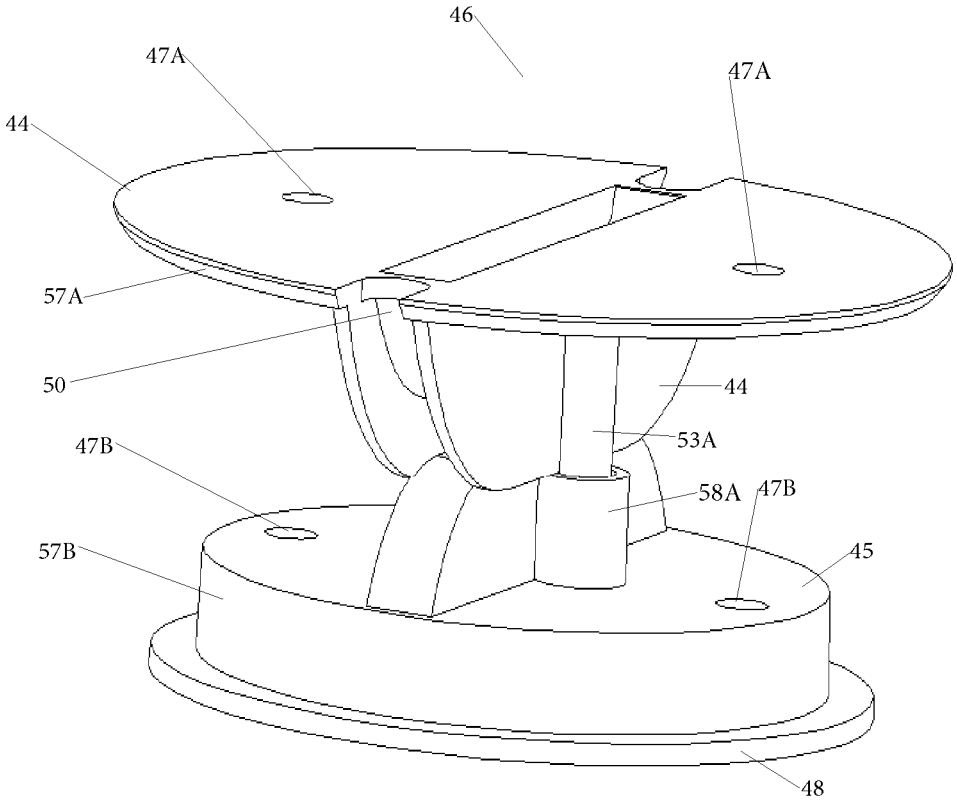
FIG. 27 is a perspective view of the capturing assembly.
Figure 28:
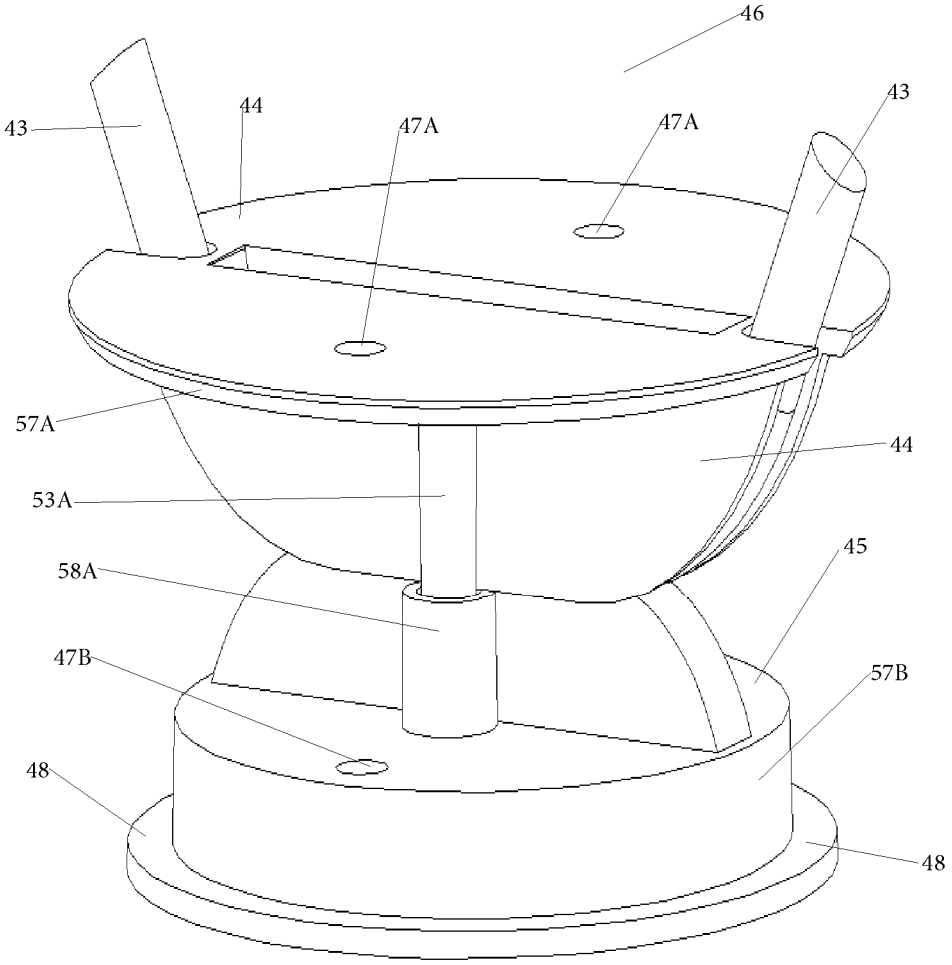
FIG. 28 is a perspective view of the capturing assembly.
Figure 29:
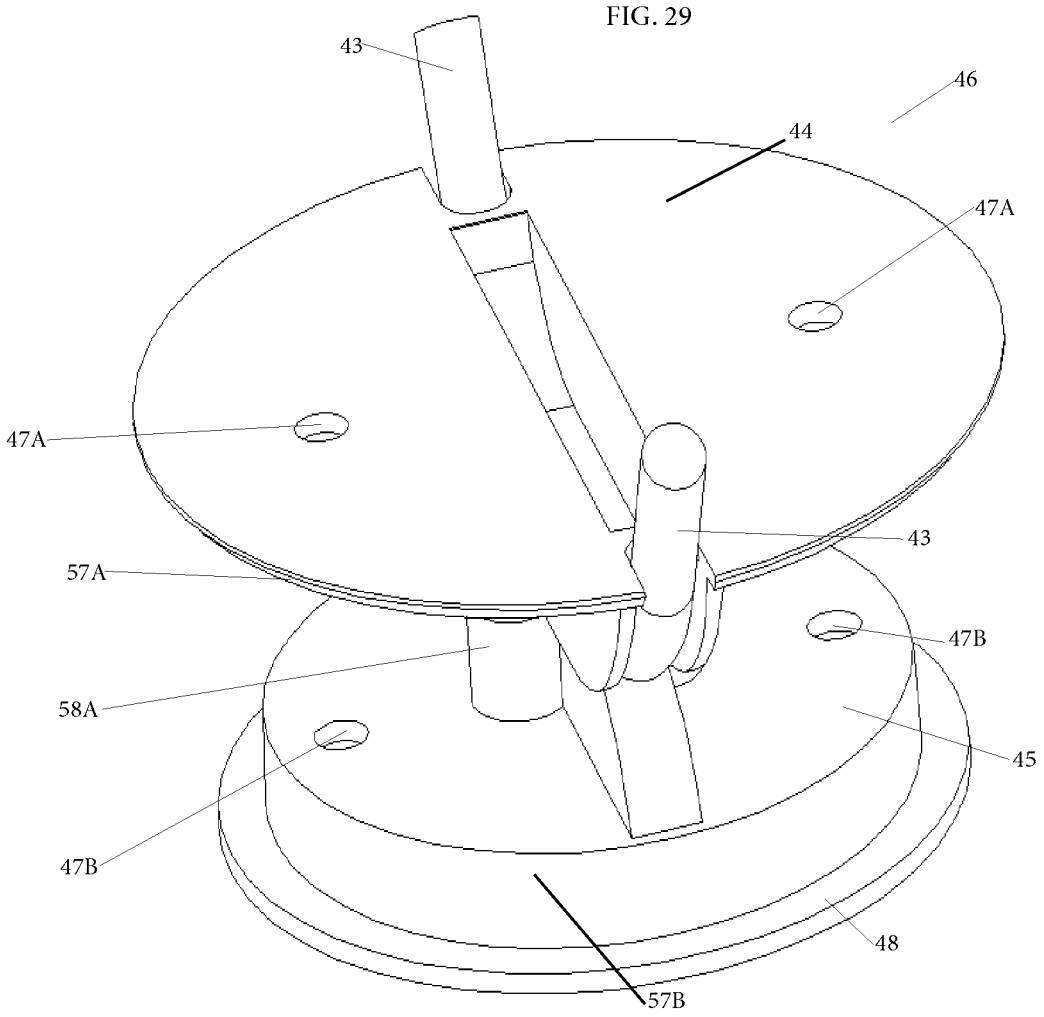
FIG. 29 is a perspective view of the capturing assembly.

FIGS. 21-23 illustrate adjustable depth anchoring system 41 for underwater light 1 having anchoring weight 42 located on an outer perimeter of capturing assembly 46 (FIG. 27-29). Anchoring weight 42 includes, but is not limited to, a sprinkler doughnut. FIGS. 21, 26, 27, 28, and 29 show upper capturing housing 44 having upper openings 47A to receive tie straps (not shown) and to receive a second anchoring structure (not shown). Capturing assembly 46 has lower capturing housing 45 (FIGS. 22, 23, 27, 28 and 29) located opposite upper capturing housing 44. Cord 43 (FIGS. 21-23, 28, and 29) is captured between cord upper capturing structure 49A (FIG. 26) and cord lower capturing structure 49B (FIG. 24). FIG. 24 shows lower capturing housing 45 having female alignment stud receiver structures 58A and 58B having female alignment stud receiver pockets 54A and 54B.

FIG. 26 shows male alignment studs 53A and 53B having screw thread receiving bosses as locating structures 52A and 52B. Upper capturing housing 44 has cord slidable ramp 50 and cord openings 51A and 51B. It is within the scope of this invention for upper capturing housing 44 to have at least one cord opening.

FIGS. 27-29 show male alignment stud 53A being received by female alignment stud receiver structure 58A. Upper capturing housing 44 has upper weight centering hub surface 57A (FIGS. 26-29) and cord slidable ramp 50 (FIGS. 26 and 27).

Figure 25:
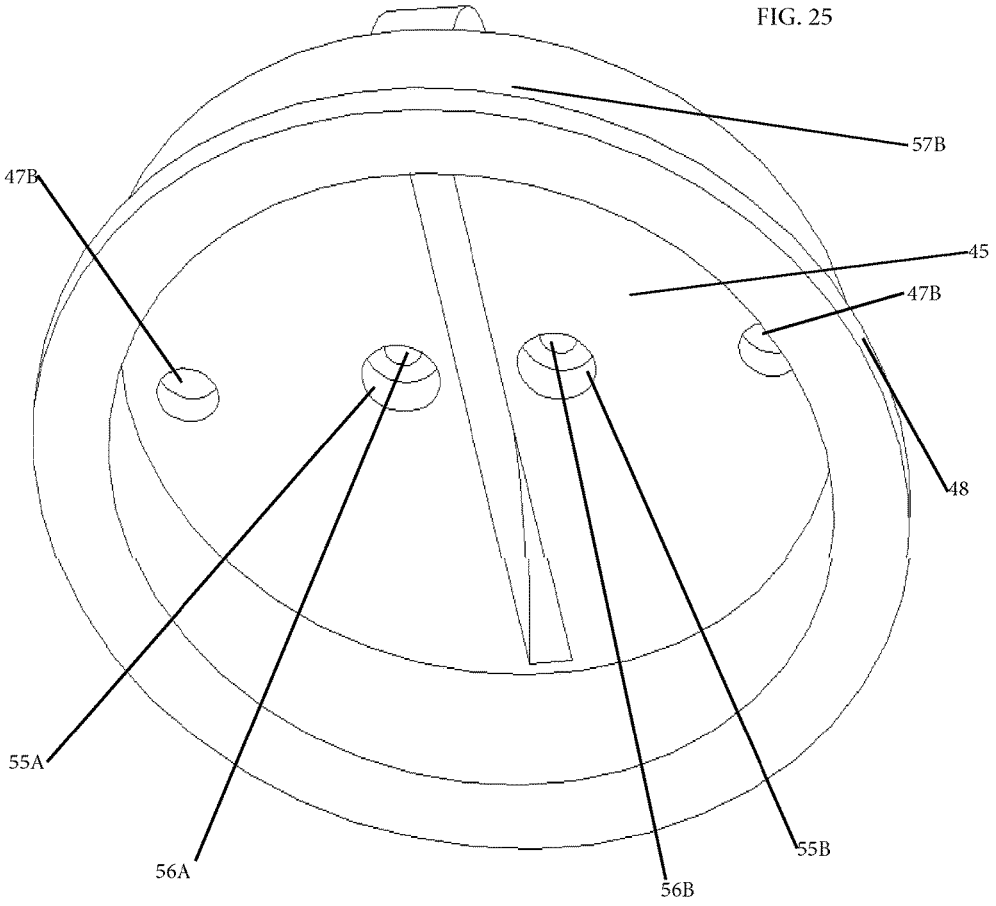
FIG. 25 is a rear perspective view of the lower capturing housing.

FIGS. 24, 25, 27-29 illustrate lower capturing housing 45 having lower openings 47B. Lower capturing housing 45 has lower weight capturing surface 48 and lower weight centering hub surface 57B. As best shown in FIG. 25, screw head flanges 55A and 55B have screw receiving holes 56A and 56B.

Transparent cover 2 has a single attaching bridging the perimeter of a primary chamber aperture 17 receiving surrounding water. The single attaching structure is configured to receive an attaching strap connected to an anchor and to suspend underwater light 1 in a vertical orientation when submerged in a body of water. Underwater light 1 displaces a volume of water causing it to be buoyant.

Housing 10 has a single attaching structure bridging the perimeter of a primary chamber aperture 17 receiving surrounding water. The single attaching structure is configured to suspend underwater light 1 in a vertical orientation when submerged in a body of water. The single attaching structure receives an attaching strap connected to an anchor.

An alternate embodiment not shown includes housing 10 having two attaching structures 8A and 8B located on an end of housing 10. The two attaching structures 8A and 8B are configured to suspend underwater light 1 in a body of water. Attaching structures 8A and 8B are each located outboard of the perimeter of a primary chamber aperture 17 receiving surrounding water. The two attaching structures 8A and 8B each have one attaching structure opening 9A and 9B to receive an attaching strap 59 (FIGS. 30-34).

FIG. 18 depicts housing 10 having valve stem opening 26 to accommodate a tire valve stem (not shown) capable of removing or filling underwater light 1 with a gas. A user has the ability to remove air from the inside of underwater light 1 and to fill underwater light 1 with an inert gas. This prevents water droplets from condensation and building up on the inside surfaces of underwater light 1, causing damage to circuitry inside the light. Internal pressure from within the light also aids in leak detection and leak prevention.

Figure 7:
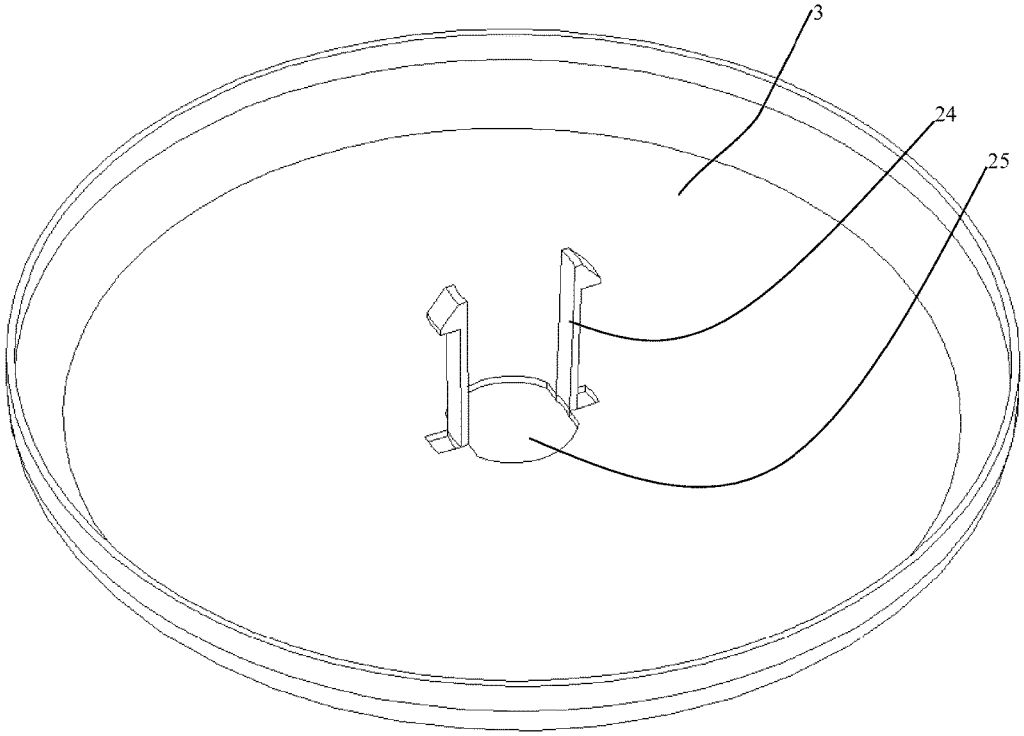
FIG. 7 is a rear perspective view of the latching structure of the transparent lens.

FIG. 3 depicts four supporting surfaces 22A, 22B, 22C, and 22D each support two light emitting units 19 A and 19 E, 19B and 19F, 19C and 19G, 19D and 19H. Each of supporting surfaces 22A, 22B, 22C, and 22D support a primary light emitting unit of a primary color 19A, 19B, 19C, and 19D and a secondary light emitting unit of a secondary color 19E, 19F, 19G, and 19H. FIG. 7 shows primary light emitting unit of a primary color 19A and 19B and secondary light emitting unit of a secondary color 19E and 19F are oriented in an upper and lower position related to central axis 30 of internal cooling system 20.

Figure 17:
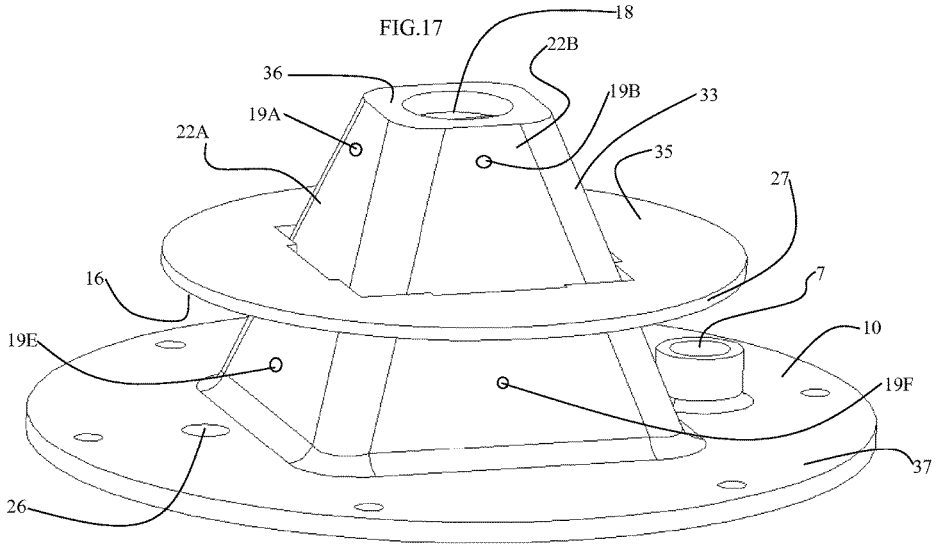
FIG. 17 is a perspective view depicting an embodiment of the thermally conductive housing having a light bifurcating structure.

As shown in FIG. 17, housing 10 has light bifurcating structure 27 having light bifurcating structure primary surface 35 located opposite light bifurcating structure secondary surface 16. Light bifurcating structure 27 is positioned between primary light emitting unit of a primary color 19A, 19B, 19C (FIG. 3), and 19D (FIG. 3) and secondary light emitting unit of a secondary color 19E, 19F, 19G (FIG. 3), and 19H (FIG. 3). Light bifurcating structure 27 extends from a point substantially related to or connected to a surface supporting a primary light emitting unit of a primary color and a secondary light emitting unit of a secondary color. Light bifurcating structure 27 extends away from the point of contact of primary light emitting units of a primary color 19A, 19B, 19C, and 19D and secondary light emitting units of a secondary color 19E, 19F, 19G, and 19H extends to a point where light bifurcating structure 27 obstructs at least a portion of light from primary light emitting units of a primary color 19A, 19B, 19C, and 19D and a portion of light from secondary light emitting units of a secondary color 19E, 19F, 19G, and 19H. Light bifurcating structure 27 causes an outer perimeter of water to illuminate in a primary color and a central portion of water to illuminate in a secondary color. A cord (not shown) is provided to be in electrical communication with light emitting units through power cord inlet 7 located on housing 10. The cord is connected to a power source.

Figure 1:
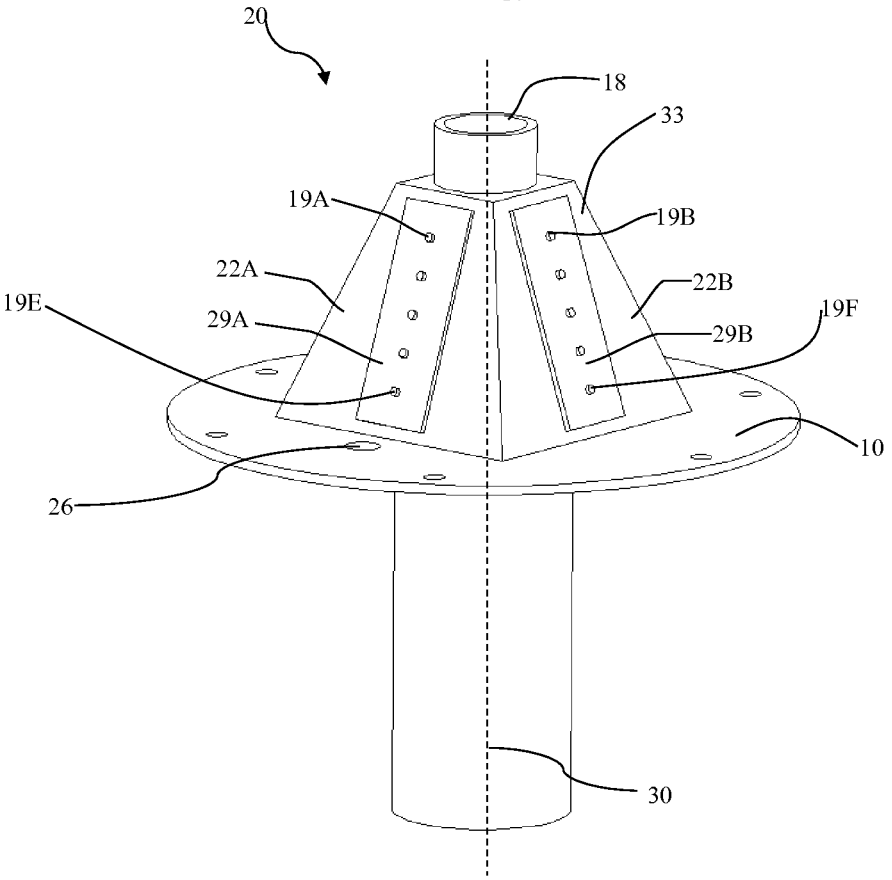
FIG. 1 is a perspective view of the internal cooling system.

Transparent cover 2 is located over housing 10. Housing 10 is constructed of a thermally conductive material. FIG. 1 describes housing 10 having primary supporting surface 22A at an angle between 0 degrees and 85 degrees in relation to central axis 30 of underwater light 1 (FIG. 18). Housing 10 has secondary supporting surface 22B at an angle between 0 degrees and 85 degrees in relation to central axis 30 of underwater light 1. Housing 10 has tertiary supporting surface 22C (FIG. 3) at an angle between 0 degrees and 85 degrees in relation to central axis 30 of underwater light 1. Housing 10 has quaternary supporting surface 22D (FIG. 3) at an angle between 0 degrees and 85 degrees in relation to central axis 30 of underwater light 1. The optimal supporting surface angle is approximately 20 degrees in relation to central axis 30 of underwater light 1. The angle range between 0 degrees and 85 degrees is to achieve a varying perimeter of light radiating from underwater light 1. FIG. 3 depicts primary supporting surface 22A, secondary supporting surface 22B, tertiary supporting surface 22C, and quaternary supporting surface 22D are each in thermal contact with light emitting units generating heat.

Primary supporting surface 22A, secondary supporting surface 22B, tertiary supporting surface 22C, and quaternary supporting surface 22D are configured to form chamber 31 having a large diameter primary chamber aperture 17 located on one end of chamber 31. As shown in FIG. 4, chamber 31 has a smaller diameter secondary chamber aperture 18 located at the opposite end of chamber 31. Primary chamber aperture 17 receives surrounding water of an ambient primary temperature. One opening located at the end of chamber 31 has a diameter at least 10 percent larger or smaller than the opening located at the opposite end of chamber 31. Depending on how tall chamber 31 is, the diameter of the larger opening will become exponentially larger as chamber 31 lengths are increased. As water absorbs the heat radiated from light emitting units, secondary chamber aperture 18 expels surrounding water from inside chamber 31 at a secondary temperature greater than the ambient primary temperature. Secondary chamber aperture 18 expelling heated water is determined by the orientation of underwater light 1. Since hot water rises, the end of chamber 31 pointing toward the surface will generally expel the heated water.

Transparent cover 2 is located over housing 10. Housing 10 is constructed of a thermally conductive material. Housing 10 has primary supporting surface 22A at an angle between 0 degrees and 85 degrees in relation to central axis 30 of underwater light 1. Housing 10 has secondary supporting surface 22B at an angle between 0 degrees and 85 degrees in relation to central axis 30 of underwater light 1. Housing 10 has tertiary supporting surface 22C at an angle between 0 degrees and 85 degrees in relation to central axis 30 of underwater light 1. The optimal supporting surface angle is approximately 20 degrees in relation to central axis 30 of underwater light 1. Primary supporting surface 22A, secondary supporting surface 22B, and tertiary supporting surface 22C are each in thermal contact with a light emitting unit generating heat. Housing 10 can be configured to have or not have chamber 31. All though not as efficient, housing 10 can be constructed primarily as a solid structure with a surface exposed to surrounding water. Housing 10 could also be constructed of a solid outer surface with its core filled with a thermally conductive material.

FIG. 19 depicts a method of constructing underwater light 1 to enable a cooling operation between housing 10 and a surrounding water source. Housing 10 is provided and has a plurality of supporting surfaces each being at an angle between 0 degrees and 85 degrees in relation to central axis 30 (FIG. 1) of underwater light 1. A plurality of light emitting units are attached to the plurality of supporting surfaces. The plurality of supporting surfaces are located on chamber wall secondary side 33 that is not in contact with water. Transparent cover 2 is provided to enclose the portion of housing 10 having the plurality of supporting surfaces. FIG. 15 shows chamber wall primary side 32 of housing 10 which is in contact with surrounding water. The surrounding water sufficiently cools light emitting units.

These embodiments are illustrative of the invention and are not exhaustive thereof. As underwater light manufacturers add additional or different structures, still further structures may be required in future embodiments of the invention but all such future embodiments are within the scope of this invention.

For example, underwater light 1 may have only one attaching structure (not shown). Thus, the single attaching structure would bridge an end of housing 10 having primary chamber aperture 17 to accommodate an attaching strap.

Underwater light 1 having two attaching structures 8A and 8B located on an end of housing 10 each have at least one attaching structure opening 9A and 9B to receive an attaching strap. The attaching straps includes, but are not limited to; a tether, tie strap, rope, or a chain, including, but not limited to being; tied, clipped, or snapped to attaching structure openings 9A and 9B.

Thus, attaching structures 8A and 8B will connect with all currently known attaching straps and in view of this disclosure any future changes in attaching structures 8A and 8B can be met.

Moreover, as mentioned, each embodiment of the illustrative embodiments will accommodate novel internal water cooling system 20, regardless of the number of supporting surfaces and configuration of housing 10 therein. In order to form chamber 31 having angled supporting surfaces, there must be at least three supporting surfaces 22A, 22B, and 22C. Although, not preferred, a cone shape without a flat supporting surface would also accommodate a plurality of supporting surfaces at an angle between 0 degrees and 85 degrees in relation to central axis 30 of underwater light 1 and also provide chamber 31.

For instance, FIG. 20 shows housing 10 with chamber 31 having primary chamber aperture 17 located at the base end of chamber 31 and an opposite secondary chamber aperture 18 located at the peak end of chamber 31, will incorporate internal water cooling system 20 (FIG. 2). Surrounding water flows through chamber 31 by entering through primary chamber aperture 17. Surrounding water contacts chamber wall primary side 32 and absorbs heat generated by light emitting units attached to chamber wall secondary side 33. Heated water is expelled through secondary chamber aperture 18.

Although, not as effective as internal water cooling system 20, a solid housing 10 not having chamber 31 will have a water cooling effect in which surrounding water comes into contact with an exposed surface of housing 10. This surface will be in thermal communication with light emitting units generating heat. The surrounding water will absorb heat from housing 10's surface in contact with surrounding water.

In addition to the aforesaid embodiments of chamber 31 of housing 10, light fixture housing 4A includes multiple additional improvements as well.

An improvement as shown in FIG. 4 includes internal water cooling system 20. Housing 10 has chamber 31 that receives surrounding water at a primary ambient temperature through primary chamber aperture 17 located on the base end of chamber 31. The water enters chamber 31 through primary chamber aperture 17 and cools the LEDs by absorbing heat generated by the LED's through chamber wall primary side 32 of housing 10. The water exits the chamber through secondary chamber aperture 18 located at the peak end of chamber 31 at a secondary temperature greater than the ambient water primary temperature. By overdriving the LED's, a substantially brighter light is produced without risk of damaging the LEDs due to the efficiency of water cooling. It is also envisioned to have the peak of chamber 31 point opposite the surface of the water to illuminate toward including, but not limited to, the sea floor or a reservoir bottom. It is also envisioned to have underwater light 1 in a horizontal position having water forced through chamber 31 due to movement of a water vehicle or water pump.

Another improvement of internal water cooling system 20 as shown in FIG. 4 has primary chamber aperture 17 accepting surrounding water. The water then flows into chamber 31 where it comes into contact with chamber wall primary side 32 of housing 10 and absorbs heat generated from a light emitting unit. The greater temperature water rises and exits chamber 31 from secondary chamber aperture 18.

Another improvement produces a large diameter of light in shallow water. Housing 10 has at least three LED circuit board supporting surfaces each configured at an angle between 0 degrees and 85 degrees in relation to central axis 30 of underwater light 1 when suspended vertically underwater from an end of underwater light 1 opposite transparent cover 2. This configuration allows the light from the LEDs to radiate outward and upward from underwater light 1 to produce a large diameter of light.

Marine life is attracted to the colored center beam of light and the white perimeter lighting illuminates the surrounding water for vivid visibility of marine life.

An important object of this invention is to provide underwater light 1 with the use of high powered LEDs by utilizing internal water cooling system 20 to absorb excessive heat. This heat absorption enables a stable environment for the LEDs to be overdriven and creates superior light penetration underwater.

In another embodiment, underwater light 1 has adjustable depth anchoring system 41 having capturing assembly 46 having upper capturing housing 44 located opposite lower capturing housing 45 (FIGS. 27-29). FIG. 26 illustrates upper capturing housing 44 having cord opening 51A and cord opening 51B configured to receive including, but not limited to, cord 43. It is within the scope of this invention for upper capturing housing to have at least one cord opening. Upper capturing housing 44 has cord capturing structure 49A. Cord 43 is in contact with a portion of cord capturing structure 49A. At least one fastener including, but not limited to, a screw (not shown) is configured to connect upper housing 44 to lower housing 45, whereby, cord 43 is captured between cord capturing structure 49A of upper capturing housing 44 and a surface of lower capturing housing 45 including, but not limited to, capturing structure 49B. It is within the scope of this invention for the cord to be captured between a capturing structure on the primary housing and a capturing structure on a secondary housing.

It is within the scope of this invention for underwater light 1 having an adjustable depth anchoring system 1 with lower housing 45 having cord slidable ramp 50. It is a preferred embodiment for upper housing 44 and lower housing 45 to each have cord slidable ramp 50.

In an alternate embodiment, cord 43 (not shown) is connected to attaching strap 59 (FIG. 31). Cord 43 (not shown) can be secured to attaching strap 59 with cord clamp 61 and cord clamp receiving structure 62 (FIG. 33). Attaching strap 59 is connected to underwater light 1 (FIG. 31). Attaching strap 59 has an end located opposite another end. As shown in FIG. 31, attaching strap 59 bridges an opening of underwater light 1. The primary distal end and the secondary distal end of attaching element 59 are each connected to underwater light 1. As shown in FIG. 34, an embodiment of underwater light 1 having an adjustable depth anchoring system 41 has at least one end of attaching strap 59 having latching structure 60. Latching structure 60 connects to underwater light 1. More particularly, latching structure 60 is received by an opening of at least one attaching structures 8A and 8B.

FIG. 21 shows capturing assembly 46 having anchoring weight 42. Anchoring weight 42 has an opening. Upper capturing housing 44 has a perimeter greater than the opening of anchoring weight 42. Lower capturing housing 45 (FIG. 22) has a perimeter greater than the opening of anchoring weight 42. Upper capturing housing 44 is located at an end of anchoring weight 42. Lower capturing housing 45 is located at an opposite end of anchoring weight 42. FIG. 28 shows upper capturing housing 44 and lower capturing housing 45 being connected with at least one fastener, such as a screw (not shown), whereby, upper capturing housing 44 and lower capturing housing 45 retain anchoring weight 42. Upper capturing housing 44 has at least one locating structure that mates with a portion of lower capturing housing 45.

In another embodiment, underwater light 1 has adjustable depth anchoring system 41 having capturing assembly 46 having upper capturing housing 44 located opposite lower capturing housing 45 (FIGS. 27-29). FIG. 26 illustrates upper capturing housing 44 having cord opening 51A and cord opening 51B configured to receive an electrically conductive element including, but not limited to, cord 43. It is within the scope of this invention for upper capturing housing to have at least one opening. Lower capturing housing has a cord capturing structure. Cord 43 is in contact with a portion of cord capturing structure 49A. At least one fastener including, but not limited to, a screw (not shown) is configured to connect upper housing 44 to lower housing 45, whereby, cord 43 is captured between cord capturing structure 49B (FIG. 24) of lower capturing housing 44 and a surface of upper capturing housing 45 including, but not limited to, capturing structure 49A. It is within the scope of this invention for the capturing assembly to be made of a heavy weight material. This allows the capturing assembly to be configured to act as an anchor without the need for additional anchoring weights to be connected to the capturing assembly.

Another important object of this invention is the method of adjusting the depth of underwater light 1 with the steps of providing underwater light 1 having cord 43. Providing upper capturing housing 44 having opening 51A and opening 52B (FIG. 26). It is within the scope of this invention for upper capturing housing to have at least one opening. Orienting cord 43 through opening 51A and opening 52B of upper capturing housing 44. Providing lower capturing housing 45. Orienting upper capturing housing 44 opposite lower capturing housing 45 forming capturing assembly 46 (FIG. 27), whereby, capturing cord 43 between a surface of upper capturing housing 44 including, but not limited to, surface 49A (FIG. 26) and a surface of lower capturing housing 45 including, but not limited to, surface 49B (FIG. 24). Connecting upper capturing housing 44 to lower capturing housing 45 with a screw (not shown), whereby, upper capturing housing 44 and lower capturing housing 45 retain cord 43 when a screw is secured.

In another embodiment, a user performs the step of loosely fitting a screw (not shown) connecting upper capturing housing 44 to lower capturing housing 45. Sliding cord 43 through opening 51A and opening 51B of upper capturing housing 44. Allowing cord 43 to alter the distance between underwater light 1 and capturing assembly 46. It is within the scope of this invention for capturing assembly 46 to be constructed of a heavy weight material including, but not limited to, steel or metal. Capturing assembly 46 being constructed of a heavy material is adapted to be weighed down by the weight of capturing assembly 46 without the need for anchoring weight 42.

Another objective of this invention is the method of adjusting the depth of underwater light 1 with performing the step of providing underwater light 1 having cord 43. Providing upper housing 44 having opening 51A and opening 51B. Orienting cord 43 through opening 51A and opening 51B of upper housing 44. Providing anchoring weight 42 including, but not limited to, a sprinkler doughnut. Anchoring weight 42 has an opening, whereby, upper housing 44 has a perimeter greater than an opening of anchoring weight 42. Positioning upper housing 44 at a primary end of anchoring weight 42. Providing lower housing 45, whereby, lower housing 45 having a perimeter greater than an opening of anchoring weight 42 (FIGS. 21 and 22). Positioning lower housing 45 at a second end of anchoring weight 42 (FIGS. 21 and 22). Connecting upper housing 44 and lower housing 45 with at least one fastener, whereby, retaining anchoring weight 42 with upper housing 44 and lower housing 45.

In another embodiment, a user performs the step of loosely fitting a screw (not shown) connecting upper housing 44 to lower housing 45. Sliding cord 43 through opening 51A and opening 51B of upper housing 44. It is within the scope of this invention for upper capturing housing to have at least one opening. Allowing cord 43 to alter the distance between underwater light 1 and anchoring weight 42. Cord 43 can be shortened or lengthened to position underwater light 1 closer to or further from the surface of the water. A screw is tightened to maintain the desired length of cord 43. It is within the scope of this invention for capturing assembly 46 to be constructed of a light weight material including, but not limited to, plastic. Capturing assembly 46 can be constructed of a light material configured to be weighed down by the weight of anchoring weight 42. It is also within the scope of this invention for a plurality of anchoring structures 42 to be attached to capturing assembly 46 to weigh capturing assembly 46 down.

In an alternate embodiment, the underwater light having an adjustable depth anchoring system has a light emitting unit having a buoyant housing connected to an electrically conductive element. The electrically conductive element is connected to an anchor, whereby, the buoyant housing is suspended above the anchor.

In another embodiment, a method of constructing an underwater light enabling a cooling operation between a thermally conductive housing and a surrounding water source has the steps of providing a thermally conductive housing comprising a thermally conductive material. Attaching a light emitting unit to the thermally conductive housing. Providing an electrical conductor in electrical communication with the light emitting unit. The electrical conductor connected to an electrical power source. Providing a transparent cover enclosing the portion of the thermally conductive housing having a light emitting unit, whereby, at least one inner wall surface of said thermally conductive housing in contact with surrounding water, whereby, the surrounding water cools the light emitting unit.

FIG. 20 illustrates an improved housing 10 eliminates the need for light fixture housing 4A. Housing 10 has a wider base that comes into contact with transparent cover 2 and is sealed by an O-ring or sealant in primary O-ring channel 38 that mates with secondary O-ring mating surface 37 of housing 10. FIG. 19 shows housing 10's base has openings to receive fasteners including, but not limited to screws or rivets. Housing 10's base has a power cord inlet 7 to receive an electrically conductive element. Housing 10 may have chamber 31 with one or two openings for internal cooling system 20 (FIG. 2) or a structure with no opening (not shown) for a cooling system that transfers heat when surrounding water comes into contact with an exposed surface of housing 10.

Additional objects include, but are not limited to, the provision of underwater light 1 having a plurality of circuit boards supporting light emitting units mounted on housing 10's chamber wall secondary side 33 at an angle between 0 degrees and 85 degrees from central axis 30 to increase the perimeter of light emitted, a higher intensity light emitted providing improved light penetration underwater due to ultra-efficient water cooling of LEDs, light bifurcating structure 27 that is positioned between a set of LED's of a primary color and a set of LED's of a secondary color, antifouling circuitry (not shown) that deters growth from attaching to underwater light 1, smart circuitry (not shown) that can communicate faults and settings to a user through multiple combinations of blinks from underwater light 1, and valve stem opening 26 to add a gas to or remove a gas from underwater light 1.

These and other important objects, advantages, and features of the invention will become clear as this description proceeds.

The invention accordingly comprises the features of construction, combination of elements, and arrangement of parts that will be exemplified in the description set fourth hereinafter and the scope of the invention will be indicated in the claims.

Construction of the Novel Underwater Light

Novel underwater light 1 can be assembled using an internal cooling system 20 (FIG. 2).

Internal Liquid Cooling System 20: As shown in FIG. 1, internal liquid cooling system 20 has housing 10 constructed of a plurality of supporting surfaces 22A, 22B, 22C (FIG. 3), and 22D (FIG. 3) and has central axis 30. Valve stem opening 26 is located on housing 10. Chamber 31 (FIG. 4) has chamber wall secondary side 33 that is in contact with circuit boards 29A and 29B. Secondary chamber aperture 18 expels heated water. FIGS. 1 and 3 illustrate supporting surface 22A is in thermal contact with circuit board 29A connected to light emitting unit 19A and 19E generating heat. Mounting surface 22B is in thermal contact with circuit board 29B connected to light emitting unit 19B and 19F generating heat. FIG. 3 shows supporting surface 22C is in thermal contact with circuit board 29C connected to light emitting unit 19C and 19G generating heat. Supporting surface 22D is in thermal contact with circuit board 29D having a light emitting unit 19D and 19H generating heat. Housing 10 has power cord inlet 7 connected to a power cord (not shown) and valve stem opening 26 connected to a valve stem (not shown). FIG. 4 illustrates primary chamber aperture 17 receives surrounding water that contacts chamber wall primary side 32 and absorbs heat from a light emitting unit. Secondary chamber aperture 18 expels the heated water.

In FIG. 2, internal liquid cooling system 20 has housing 10 having a chamber opening 17 located on an end of port tube 40. Chamber wall secondary side 33 is where supporting surfaces 22A, 22B, 22C (FIG. 3), and 22D (FIG. 3) are located and do not come in contact with water. Supporting surface 22A is in thermal contact with circuit board 29A connected to light emitting unit 19A generating heat. Supporting surface 22B is in thermal contact with circuit board 29B connected to light emitting unit 19B.

As best understood in connection with FIG. 3, primary supporting surface 22A, secondary supporting surface 22B, tertiary supporting surface 22C, and quaternary supporting surface 22D form chamber 31 (FIG. 4) for water to come into contact with chamber wall primary side 32 and absorb heat generated from light emitting units 19A, 19B, 19 C, and 19 D. In FIG. 4, housing 10 is oriented with the peak of the chamber facing toward the surface of the water when submerged. Primary chamber aperture 17 receives surrounding water. Secondary chamber aperture 18 discharges the heated water. FIG. 4 illustrates internal cooling system 20 having housing 10 with power cord inlet 7 connected to a power cord (not shown) and valve stem opening 26 connected to a valve stem (not shown).

Figure 5:
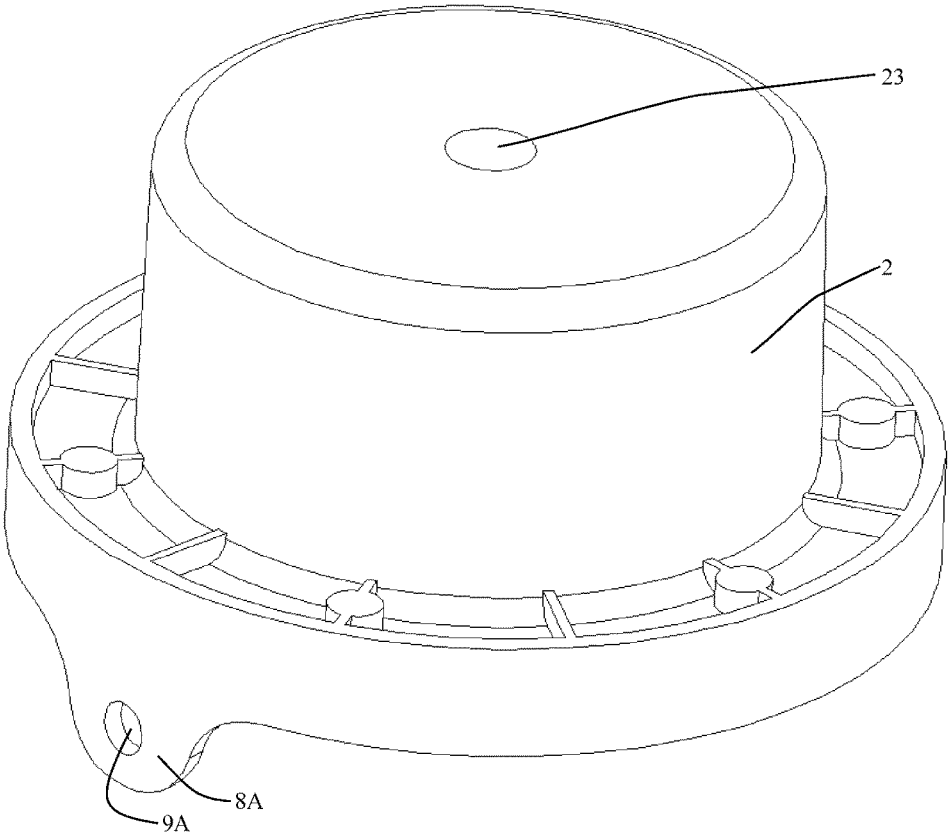
FIG. 5 is a perspective view of the transparent cover opening.
Figure 10:
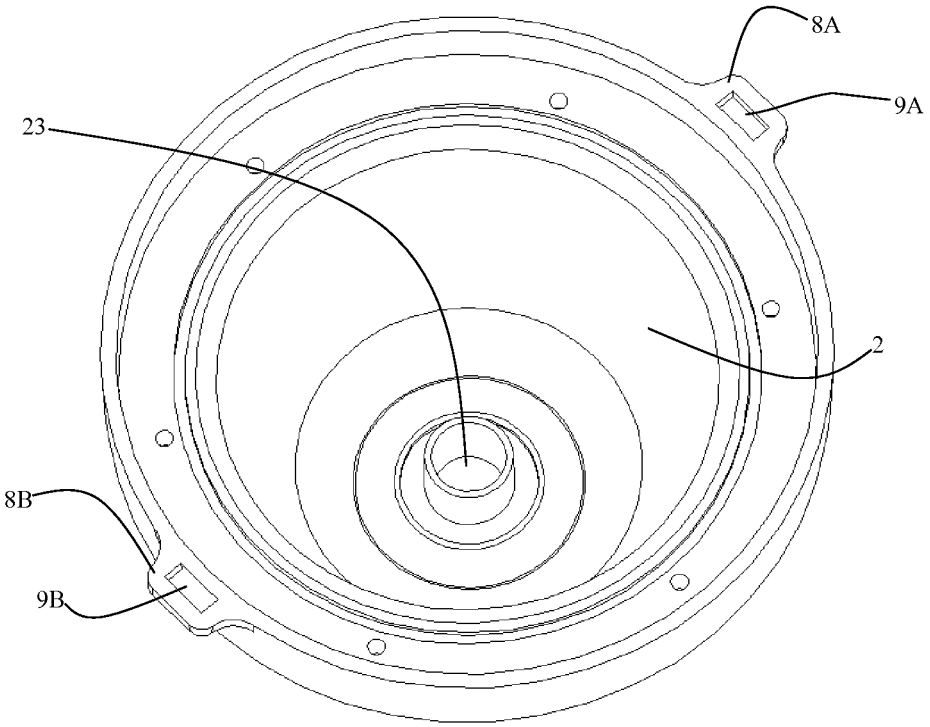
FIG. 10 is a rear perspective view of the inside of the transparent cover having an alternate embodiment with attaching structures.
Figure 11:
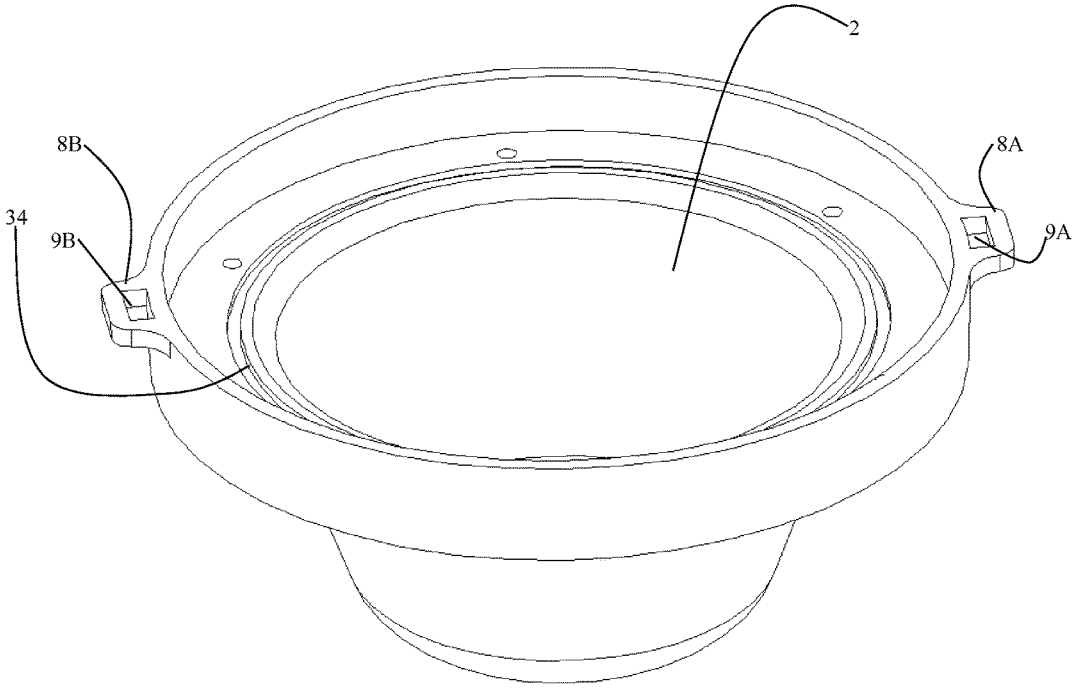
FIG. 11 is a perspective view of the transparent cover having an alternate embodiment with attaching structures.
Figure 12:
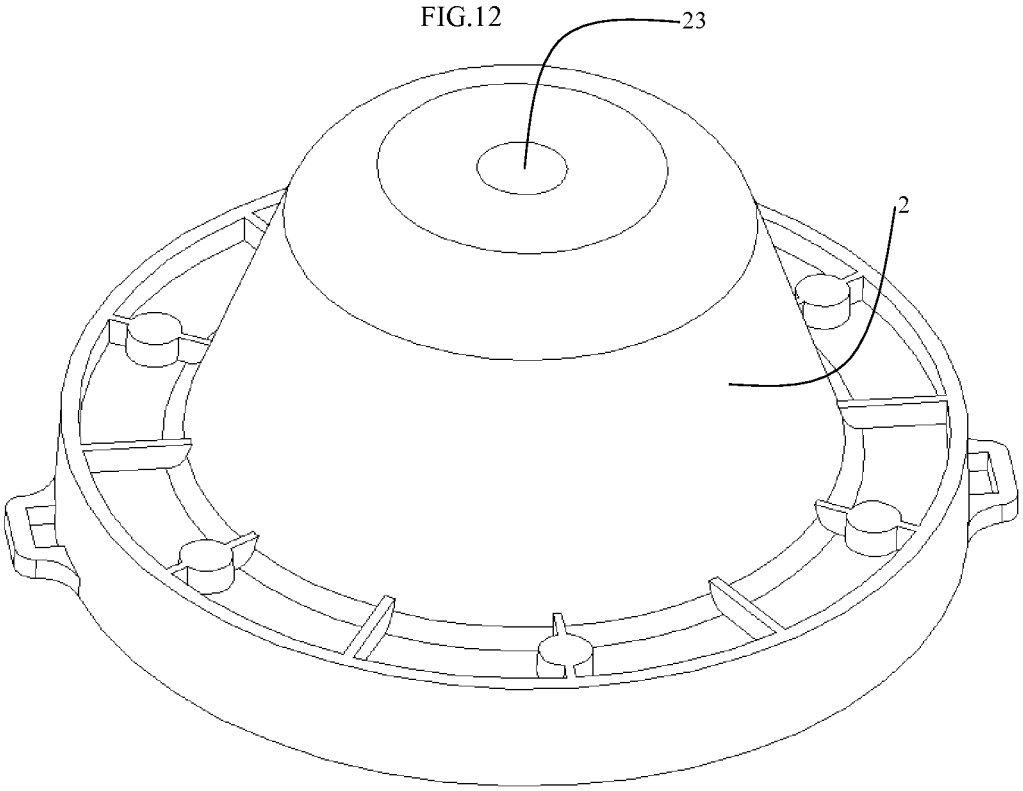
FIG. 12 is a perspective view of the top of the transparent cover.

Transparent Cover 2: As shown in FIG. 5, transparent cover opening 23 is located on an end of transparent cover 2. FIGS. 5 and 6 both depict attaching structure 8A having attaching structure opening 9A. FIG. 6 depicts attaching structure 8B having attaching structure opening 9B. FIGS. 10 and 11 depict a second embodiment of attaching structure 8A having opening 9A and attaching structure 8B as having attaching structure opening 9B. FIG. 11 illustrates transparent cover 2 having seal groove 34 that receives an O-ring (not shown). FIGS. 6, 10, and 12 illustrate transparent cover 2 having transparent cover opening 23.

Figure 9:
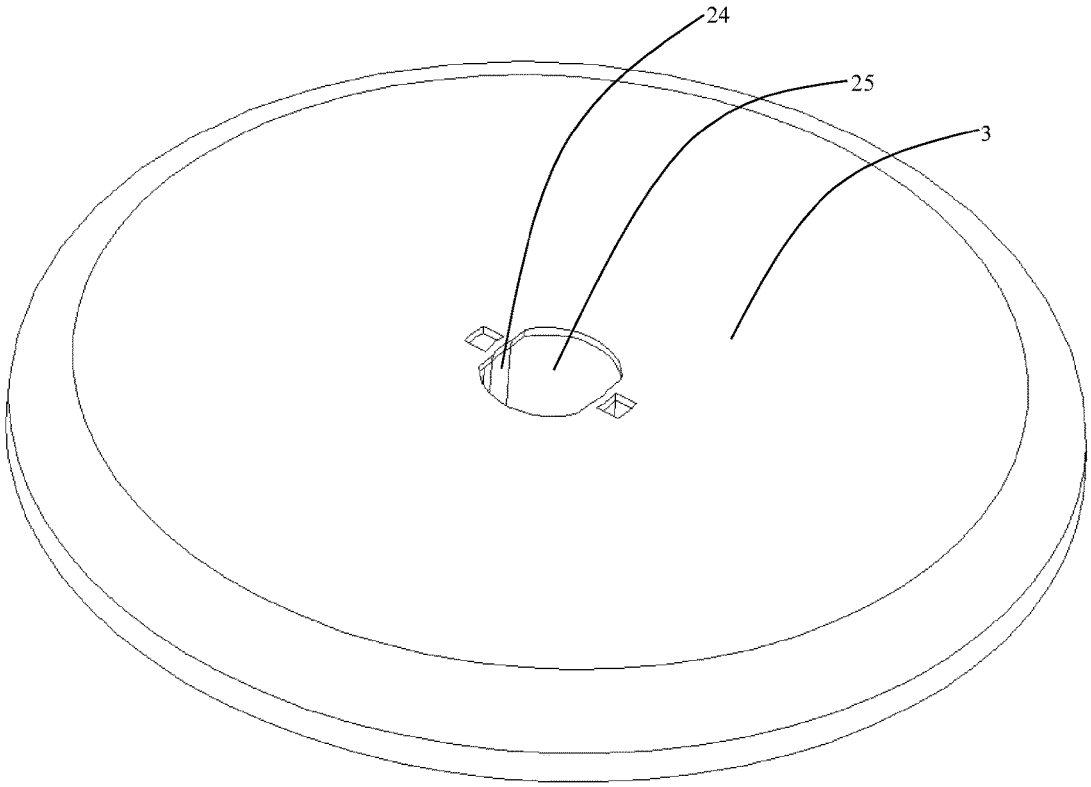
FIG. 9 is a perspective view of the top of the transparent lens.

As seen in FIGS. 7-9, transparent lens 3 has a transparent lens latching structure 24 and transparent lens opening 25. Transparent lens latching structure 24 is received by transparent cover opening 23 (FIG. 12).

Figure 13:
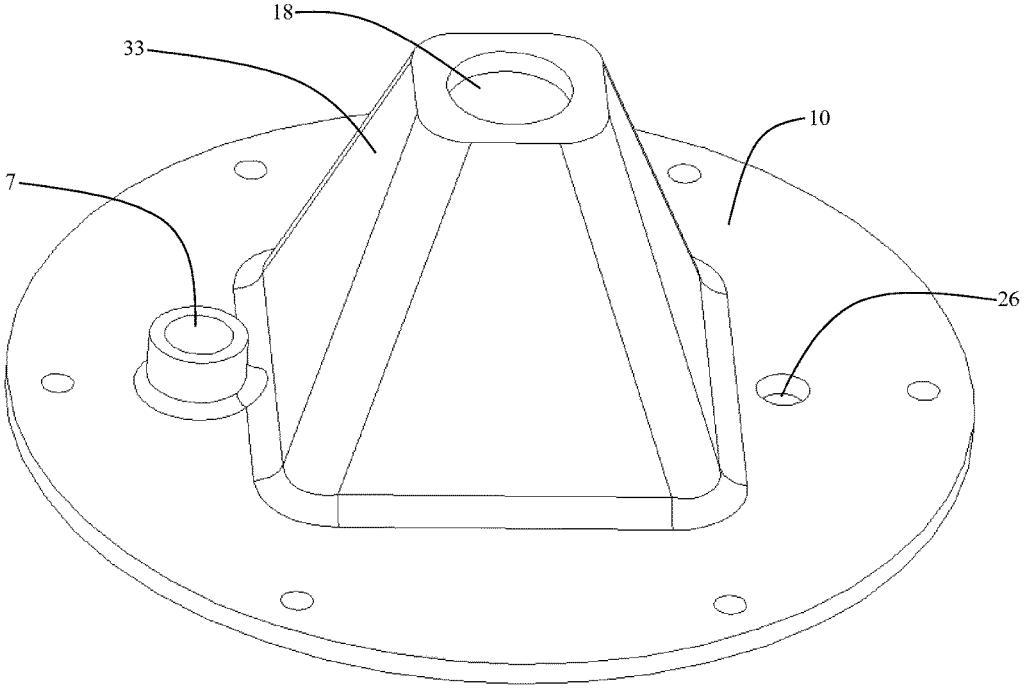
Figure 14:
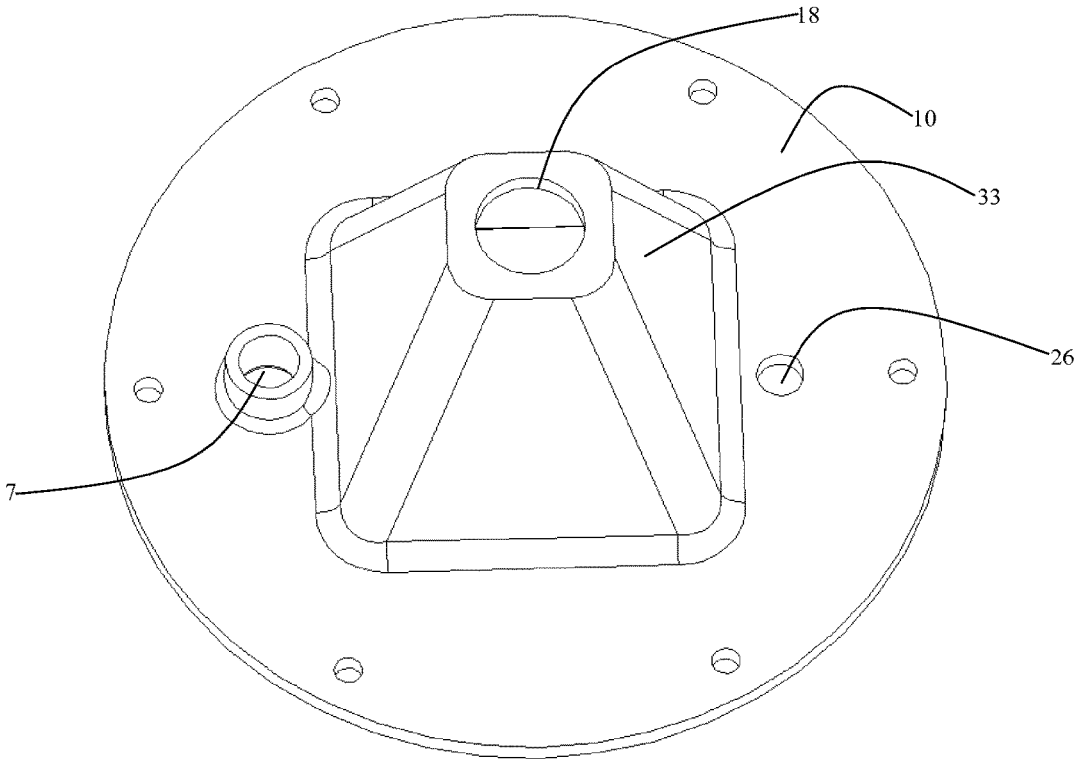
FIG. 14 is a top perspective view depicting an embodiment of the thermally conductive housing having an opening for a valve stem.

FIGS. 13-16 depict housing 10 having a valve stem opening 26. FIGS. 13 and 14 show chamber 31 (FIG. 15) having a chamber wall having a secondary side 33 that does not contact surrounding water. Power cord inlet 7 is located on housing 10. Heated water is expelled through secondary chamber aperture 18. FIG. 15 shows that surrounding water can enter chamber 31 through primary chamber aperture 17. The surrounding water comes into contact with the chamber wall primary side 32. FIG. 17 depicts light bifurcating structure 27 having light bifurcating structure primary surface 35 located opposite light bifurcating structure secondary surface 16. Light bifurcating structure 27 is located between light emitting units 19A and 19 E and 19B and 19 F. Power cord inlet 7 is located on housing 10 and receives a power cord (not shown). FIGS. 17 and 18 illustrate heated water (not shown) is expelled through secondary chamber aperture 18. Primary O-ring mating surface 36 comes into contact with secondary O-ring channel 39 (FIG. 20). Secondary O-ring mating surface 37 comes into contact with primary O-ring channel 38 (FIGS. 19 and 20). Chamber wall secondary side 33 does not contact surrounding water. Valve stem opening 26 is connected to a valve stem (not shown). As best shown in FIG. 20, housing 10 has secondary O-ring mating surface 37 which comes into contact with primary O-ring channel 38. Primary O-ring mating surface 36 comes into contact with secondary O-ring channel 39.

FIGS. 18-20 illustrate transparent cover 2 having transparent cover opening 23 (FIGS. 18 and 20) over housing 10. Chamber 31 (FIGS. 19 and 20) has secondary chamber opening 18 located opposite primary chamber opening 17 (FIGS. 19 and 20). Chamber 31 has a chamber wall secondary side 33 (FIGS. 17-20) that is not exposed to water and chamber wall primary side 32 that is exposed to water (FIGS. 19 and 20). Supporting surface 22A and 22B (FIGS. 17-19) are located on chamber wall secondary side 33 (FIGS. 17-20). Valve stem opening 26 is located on housing 10. Power cord inlet 7 is located on housing 10.

Terms

As used herein, the term "electrically conductive element", refers to any medium that transfers an electrical current. Examples include, but are not limited to: an electrical cord, circuit board, light bulb, or bulb socket.

As used herein, the term "hydro communication", refers to any path that water can move from one point to another.

As used herein, the term "light emitting unit", refers to anything that electrically generates illumination including, but not limited to; an incandescent bulb, a CFL bulb, or an LED bulb.

As used herein, the term "clear", refers to being a color.

As used herein, the term "anchor", includes, but is not limited to; any securing structure or weight.

As used herein, the term "vertical orientation", refers to configuration of the underwater light directing the transparent cover's distal end toward or away from a surrounding water's surface.

As used herein, the term "antifouling circuitry", refers to any circuitry capable of automatically cycling the power to the underwater light "on" and "off" multiple times for a predetermined duration during periods of non-use.

As used herein, the term "mounting surface", refers to any surface that supports components that emit light and generate heat including, but not limited to; circuit boards containing LED's.

As used herein, the term "thermal contact", refers to any transfer of heat from one surface to another including, but not limited to; an underlying surface, a light emitting unit, a structure, or a water source.

As used herein, the term "thermal communication", refers to any transfer of heat from one source to another including, but not limited to; a light emitting unit, a structure, or a water source.

As used herein, the term "surrounding water", refers to any water that comes into contact with the underwater light when submerged in a body of water.

As used herein, the term "attaching element", refers to any securing material, including but not limited to; a tether, rope, chain, or tie strap.

As used herein, the term "thermally conductive material", refers to any material that can absorb, release, or transfer heat.

As used herein, the term "valve", refers to any releasable mechanism allowing a user to fill or remove a gas from within the sealed area of the underwater light.

As used herein, the term "transparent cover", refers to any translucent barrier between a water source and a light emitting unit.

As used herein, the term "cord", refers to any length of material. Examples include, but are not limited to: an electrical cord, an electrically conductive element, a rope, a chain, or a string.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall there between.

Now that the invention has been described,

The invention claimed is:

1. An underwater light, comprising:

an adjustable anchoring system comprising a capturing assembly comprising a first housing located opposite a second housing;

said first housing comprising a top comprising a first and a second opening;

said first housing comprising a first capturing surface;

said second housing comprising a second capturing surface;

said first and second housings adapted to be interconnected with said first and second capturing surfaces positioned in close proximity such that a cord of said underwater light may enter said first opening of said first housing, is captured between said first capturing surface and said second capturing surface, and then exits through said second opening of said first housing whereby said cord both enters and exits said top of said first housing, said cord configured to suspend said underwater light above said anchoring system when the underwater light and anchoring system are submerged in a body of water.

2. The underwater light of claim 1, wherein:

said cord is connected to a strap connected to said underwater light.

3. The underwater light of claim 2, wherein:

said strap comprises a first distal end located opposite a second distal end, said first distal end and said second distal end each connected to said underwater light.

4. The underwater light of claim 3, further comprising:

a housing comprising an opening;

said strap bridging said opening of said underwater light.

5. The underwater light of claim 3, wherein:

at least one distal end of said strap comprises a latching structure, whereby, said latching structure connects to said underwater light.

6. The underwater light of claim 1, wherein:

said capturing assembly is configured to connect to a weight, said weight configured to sink to the bottom of a body of water and pull said underwater light completely under water;

said weight comprising an opening;

said first housing comprising a perimeter greater than said opening of said weight, said second housing comprising a perimeter greater than said opening of said weight, said first and said second housings being located at opposing ends of said weight; and, said first housing and said second housing connected by at least one fastener, whereby, said first housing and said second housing retain said weight.

* * * * *